US011276369B2

(12) United States Patent
Jung et al.

(10) Patent No.: US 11,276,369 B2
(45) Date of Patent: Mar. 15, 2022

(54) ELECTRONIC DISPLAY BURN-IN DETECTION AND MITIGATION

(71) Applicant: Apple Inc., Cupertino, CA (US)

(72) Inventors: Tobias Jung, San Francisco, CA (US); Marc Albrecht, San Francisco, CA (US); Paul S. Drzaic, Morgan Hill, CA (US); Tae-Wook Koh, Los Gatos, CA (US); Teun R. Baar, San Francisco, CA (US); Yifan Zhang, San Carlos, CA (US); Ramin Samadani, Menlo Park, CA (US); Nicolas P. Bonnier, Campbell, CA (US)

(73) Assignee: Apple Inc., Cuptertino, CA (US)

( * ) Notice: Subject to any disclaimer, the term of this patent is extended or adjusted under 35 U.S.C. 154(b) by 392 days.

(21) Appl. No.: 15/948,796

(22) Filed: Apr. 9, 2018

(65) Prior Publication Data

US 2019/0080670 A1 Mar. 14, 2019

Related U.S. Application Data

(60) Provisional application No. 62/556,141, filed on Sep. 8, 2017.

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/046* (2013.01); *G09G 2320/0626* (2013.01); *G09G 2320/0673* (2013.01); *G09G 2320/0686* (2013.01); *G09G 2360/16* (2013.01)

(58) Field of Classification Search
CPC ..... G09G 5/10; G09G 3/20; G09G 2320/046; G09G 2320/0626; G09G 2320/0673; G09G 2320/0686; G09G 2360/01; G09G 2360/16
See application file for complete search history.

(56) References Cited

U.S. PATENT DOCUMENTS

| | | | | |
|---|---|---|---|---|
| 8,054,252 | B2 * | 11/2011 | Tada | G09G 3/3208 345/76 |
| 10,269,110 | B2 * | 4/2019 | Forutanpour | G06K 9/52 |
| 2005/0212726 | A1 * | 9/2005 | Namba | G09G 3/22 345/63 |
| 2007/0127569 | A1 * | 6/2007 | Hatalkar | G09G 5/00 375/240.12 |
| 2010/0026731 | A1 * | 2/2010 | Konuma | G09G 5/04 345/690 |

(Continued)

*Primary Examiner* — Alexander Eisen
*Assistant Examiner* — Nathaniel P Brittingham
(74) *Attorney, Agent, or Firm* — Fletcher Yoder P.C.

(57) ABSTRACT

Systems, methods, and devices are provided to reduce a likelihood of image burn-in on an electronic display. Such an electronic device may include image processing circuitry and an electronic display. The image processing circuitry may receive image data and analyze the image data for risk of image burn-in and, based at least in part on the analysis of the image data, reduce a risk of image burn-in at least in part by reducing a local maximum pixel luminance value in at least one of a plurality of regions of the image data over time or by reducing a dynamic range headroom of the image data. The electronic display may display the image data with a reduced risk of image burn-in on the pixels of the electronic display.

23 Claims, 15 Drawing Sheets

(56) References Cited

U.S. PATENT DOCUMENTS

| | | | | |
|---|---|---|---|---|
| 2011/0216084 | A1* | 9/2011 | Mori | H04N 5/58 345/589 |
| 2012/0182332 | A1* | 7/2012 | Liu | G09G 3/2007 345/691 |
| 2012/0274669 | A1* | 11/2012 | Neal | G09G 3/342 345/690 |
| 2012/0299892 | A1* | 11/2012 | Hotelling | G09G 3/3677 345/209 |
| 2013/0335438 | A1* | 12/2013 | Ward | G06T 5/009 345/589 |
| 2014/0002335 | A1* | 1/2014 | Oda | G09G 3/3406 345/102 |
| 2014/0375704 | A1* | 12/2014 | Bi | G09G 3/3233 345/694 |
| 2016/0132999 | A1* | 5/2016 | Kwon | G06T 5/008 345/593 |
| 2017/0004753 | A1* | 1/2017 | Kim | G09G 3/3233 |
| 2017/0116915 | A1* | 4/2017 | Song | G09G 3/20 |
| 2017/0372465 | A1* | 12/2017 | Forutanpour | G06K 9/52 |
| 2019/0073558 | A1* | 3/2019 | Otake | G06T 5/001 |
| 2019/0080670 | A1* | 3/2019 | Jung | G09G 5/10 |

* cited by examiner

ELECTRONIC DISPLAY BURN-IN DETECTION AND MITIGATION

This application claims priority to and benefit from U.S. Provisional Application No. 62/556,141, entitled "Electronic Display Burn-In Detection and Mitigation," filed Sep. 8, 2017, the contents of which is incorporated by reference in its entirety.

BACKGROUND

This disclosure relates to adjusting image data to mitigate image burn-in on pixels of an electronic display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Numerous electronic devices—such as televisions, portable phones, computers, wearable devices, vehicle dashboards, virtual-reality glasses, and more—include electronic displays. As electronic displays gain increasingly higher resolutions and dynamic ranges, they may also become increasingly more susceptible to image display artifacts due to pixel burn-in. Burn-in is a phenomenon whereby pixels degrade over time after emitting a particularly high amount of light over time. To prevent artifacts from appearing on the electronic display due to burn-in effects, the image data may be adjusted over time in response to the existing amount of burn-in that has already occurred. While this may avoid some visual artifacts from appearing due to burn-in that has already occurred, it may not substantially prevent the burn-in effect from occurring in the first place.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure provides systems and methods for proactively preventing display burn-in by (1) locally adjusting image data using local tone mapping when a local risk of burn-in is detected and/or by (2) locally or globally adjusting an amount of dynamic range headroom slowly over time when a risk of burn-in is identified. In the first example, to proactively prevent display burn-in, image data may be analyzed and locally adjusted where a local risk of burn-in is identified. Areas of image data that are especially bright could, if displayed on an electronic display for a long enough time, cause the pixels in the bright areas to age much more rapidly than other pixels on the electronic display. This could result in display pixel burn-in effects on those pixels. Thus, the image data may be analyzed to identify the areas subject to local burn-in risk and preemptively adjust those areas by reducing the local maximum brightness.

Indeed, in some cases, a frame of image data may be divided into separate cells. A histogram of the luminance values of pixels or a histogram of saturated pixels in each cell may be generated and analyzed to identify a burn-in risk value for each cell. Since a total amount of burn-in risks may be cumulative over time, the burn-in risk for each cell may be temporally filtered over time and/or accumulated. When the burn-in risk for a cell of the image data exceeds some threshold, this may signify that the cell has a high-enough burn-in risk that burn-in mitigation may be warranted to mitigate the effects of burn-in on the pixels of the cell. To mitigate the risk of burn-in on pixels of the cell, the local maximum pixel luminance value may be reduced in the cell.

In some cases, even though the local maximum pixel luminance value in a cell is reduced, it may be substantially imperceptible to the human eye. For example, to reduce the local maximum pixel luminance value while introducing relatively little distortion—ideally, introducing such a low amount of distortion that it cannot be readily detected by the human eye the reduced local maximum pixel luminance value may be used by a local tone mapping engine to substantially preserve local contrast even while reducing the maximum pixel luminance value of pixels of the cell instead of clipping. For example, local tone mapping may be used to map a portion of the highest gray levels found in a cell of input image data to lower-level gray levels in the cell as output image data, thereby lowering the local maximum pixel luminance value in that cell. At the same time, the local tone mapping may avoid reducing the luminance of most other the gray levels. By reducing the maximum brightness emitted by any of the pixels of the affected cell in this way, the amount of burn-in due to the pixels displaying high luminances may be reduced in those cells without introducing noticeable visual artifacts.

Additionally or alternatively, an amount of dynamic range headroom may be adjusted locally or globally over time to reduce a risk of burn-in when a sufficiently high risk of burn-in is identified. The dynamic range headroom represents the maximum amount of contrast in the image data that is to be displayed on the electronic display, and may be expressed in units of "stops." In general, displaying images with more dynamic range headroom is more visually appealing because it provides for higher contrast due to a higher maximum light output for the brightest pixels (while the darkest pixels with the lowest light output may remain equally dark regardless the amount of headroom). As electronic displays increasingly gain the functionality to output higher and higher amounts of light, however, a dynamic range headroom that allows too much light to be output by the same pixels for an extended period of time could result in image burn-in in the same manner as mentioned above.

Thus, another way of proactively preventing image display burn-in, which could be used in conjunction with or separately with the systems and methods mentioned above, may involve selectively adjusting the amount of available headroom based on a computed risk of burn-in. Moreover, the adjustment in headroom may take place over sufficiently long periods of time that the effect may be substantially imperceptible to anyone viewing the electronic display. This relatively long adjustment period may also permit the computed risk of burn-in to be determined on a relatively sparse or slow basis. For example, even though image frames may be displayed on the electronic display multiples times a second, the burn-in risk may be determined once every multiple of seconds or even minutes. Moreover, adjusting the dynamic range headroom rather than scaling the entire image may only reduce the brightest of the bright pixels of image data being shown on the display. That is, for a scene that has only a few very bright areas, only the very bright areas may be adjusted because only the pixels of the very bright areas may exceed the available headroom. Thus, adjusting the dynamic range headroom in this way may allow for a proactive prevention of burn-in while also maintaining a desirable visual experience on the electronic display.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
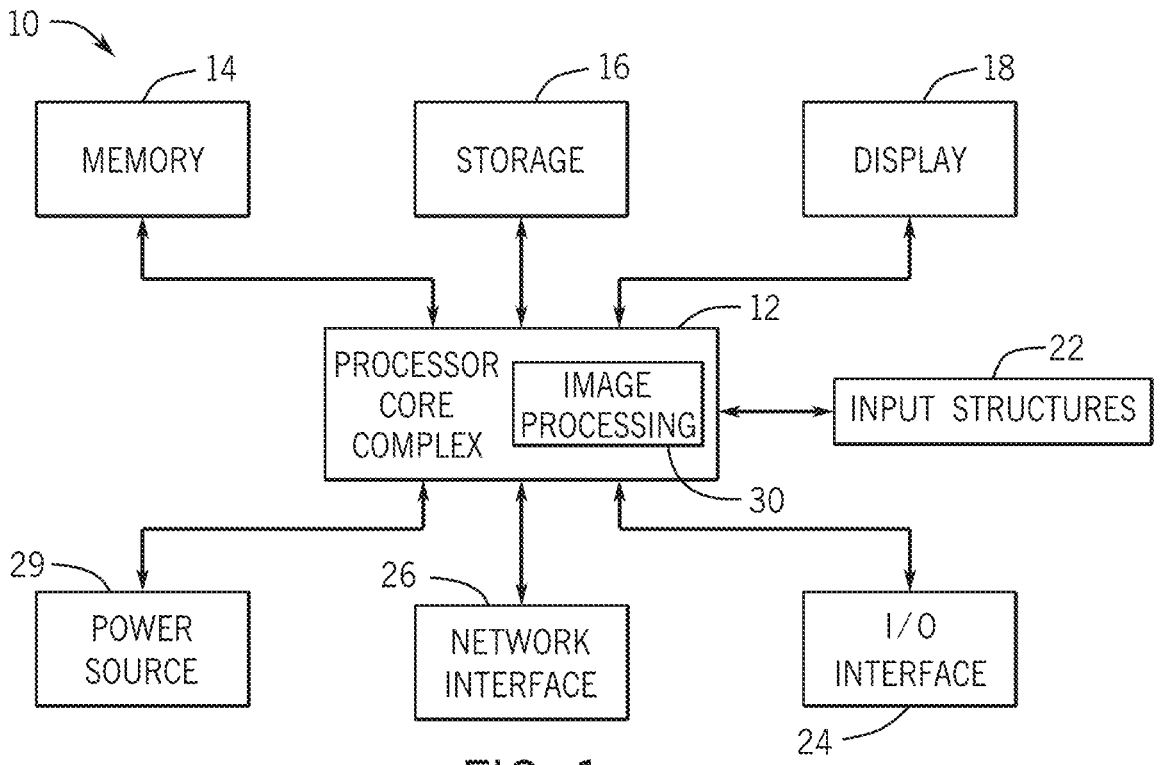
FIG. 1 is a schematic block diagram of an electronic device that performs display sensing and compensation, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As electronic displays gain increasingly higher resolutions and dynamic ranges, they may also become increasingly more susceptible to image display artifacts due to pixel burn-in. Burn-in is a phenomenon whereby pixels degrade over time after emitting a particularly high amount of light over time. Several ways to proactively prevent display burn-in are provided in this disclosure, including (1) locally adjusting image data using local tone mapping when a local risk of burn-in is detected and/or (2) locally or globally adjusting an amount of dynamic range headroom slowly over time when a risk of burn-in is identified.

In the first example, image data may be analyzed and locally adjusted where a local risk of burn-in is identified. In some cases, a frame of image data may be divided into separate cells. A histogram of the luminance values of pixels in each cell or a histogram of saturated pixels in each cell may be generated and analyzed to identify a burn-in risk value for each cell. Since a total amount of burn-in risks may be cumulative over time, the burn-in risk for each cell may be temporally filtered over time and/or accumulated. When the burn-in risk for a cell of the image data exceeds some threshold, this may signify that the cell has a high-enough burn-in risk that burn-in mitigation may be warranted to mitigate the effects of burn-in on the pixels of the cell. To mitigate the risk of burn-in on pixels of the cell, the local maximum pixel luminance value may be reduced in the cell. Moreover, if desired, a local tone mapping engine may use the new, reduced local maximum pixel luminance value to imperceptibly reduce the amount of light emitted by the pixels of the cell. This may reduce a risk of burn-in in the cell without introducing noticeable visual artifacts.

In the second example, an amount of dynamic range headroom may be adjusted locally or globally over time to reduce burn-in when a risk of burn-in is identified. As mentioned above, the dynamic range headroom represents the maximum amount of contrast in the image data that is to be displayed on the electronic display, and may be expressed in units of "stops." Although displaying images with more dynamic range headroom is generally more visually appealing, since it provides for higher contrast due to a higher maximum light output for the brightest pixels (while the darkest pixels with the lowest light output may remain equally dark regardless the amount of headroom), too much light output by the same pixels for an extended period of time could result in image burn-in in the same manner as mentioned above. Thus, selectively adjusting the amount of available headroom based on a computed risk of burn-in may reduce the likelihood of burn-in. Moreover, the adjustment in headroom may take place over sufficiently long periods of time that the effect may be substantially imperceptible to anyone viewing the electronic display. This relatively long adjustment period may also permit the computed risk of burn-in to be determined on a relatively sparse or slow basis. For example, even though image frames may be displayed on the electronic display multiples times a second, the burn-in risk may be determined once every multiple of seconds or even minutes. Moreover, adjusting the dynamic range headroom rather than scaling the entire image may only reduce the brightest of the bright pixels of image data being shown on the display. That is, for a scene that has only a few very bright areas, only the very bright areas may be adjusted because only the pixels of the very bright areas may exceed the available headroom. Thus, adjusting the dynamic range headroom in this way may allow for a proactive prevention of burn-in while also maintaining a desirable visual experience on the electronic display.

Figure 2:
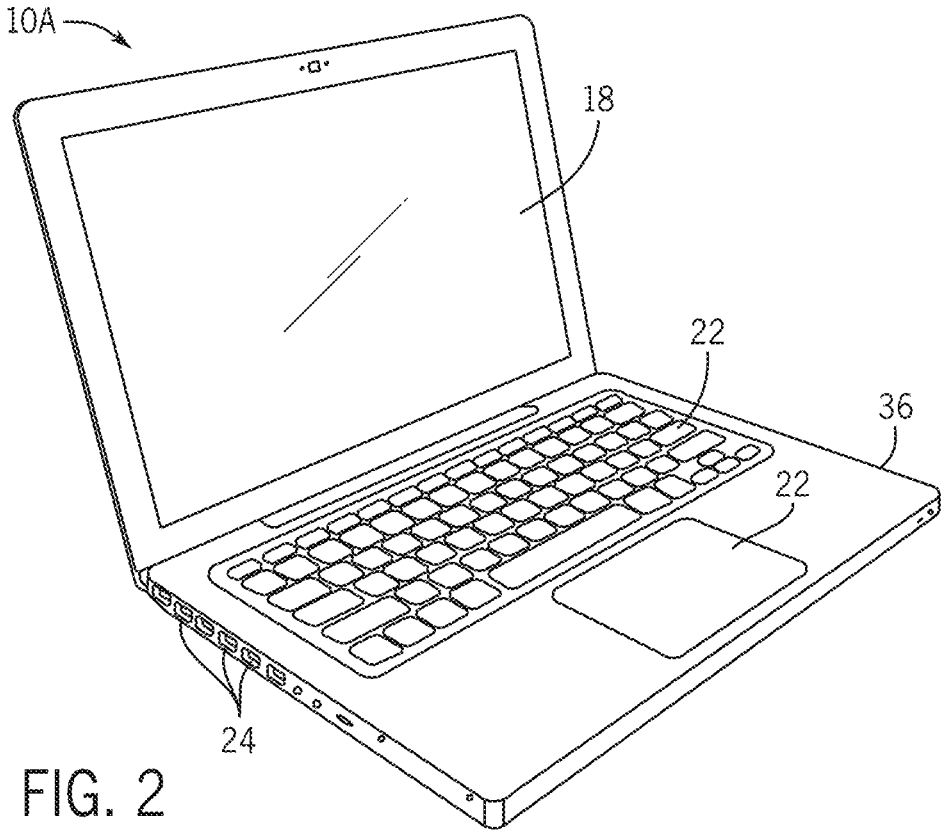
FIG. 2 is a perspective view of a notebook computer representing an embodiment of the electronic device of FIG. 1.
Figure 4:
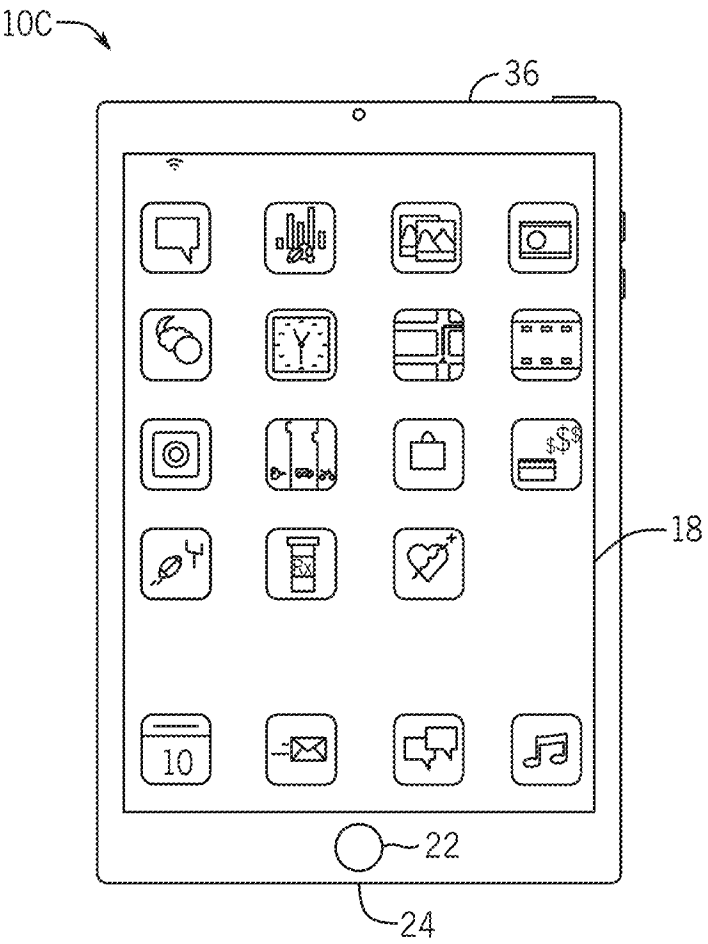
FIG. 4 is a front view of another hand-held device representing another embodiment of the electronic device of FIG. 1.
Figure 3:
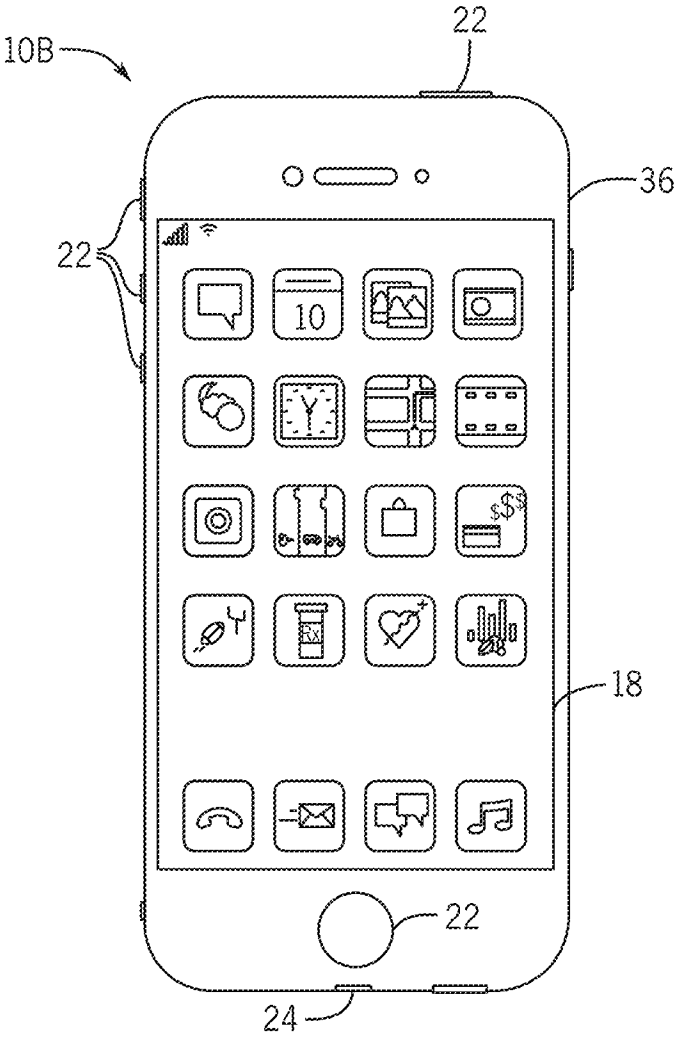
FIG. 3 is a front view of a hand-held device representing another embodiment of the electronic device of FIG. 1.
Figure 5:
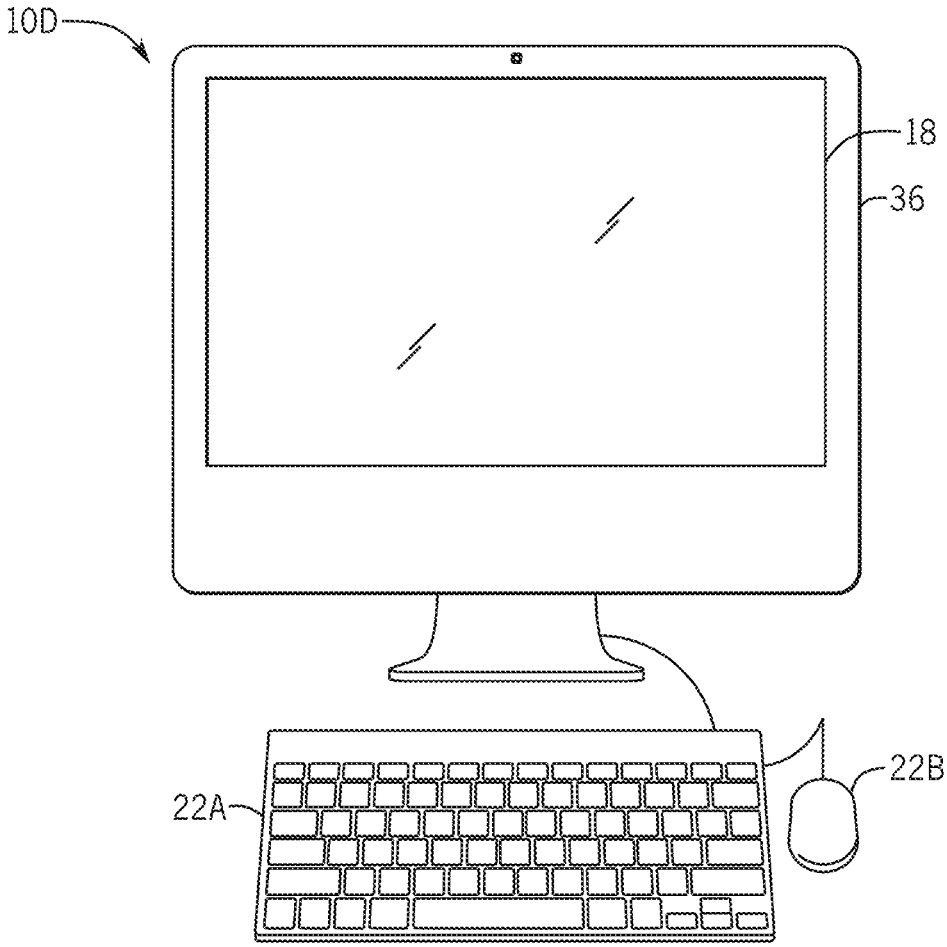
FIG. 5 is a front view of a desktop computer representing another embodiment of the electronic device of FIG. 1.
Figure 6:
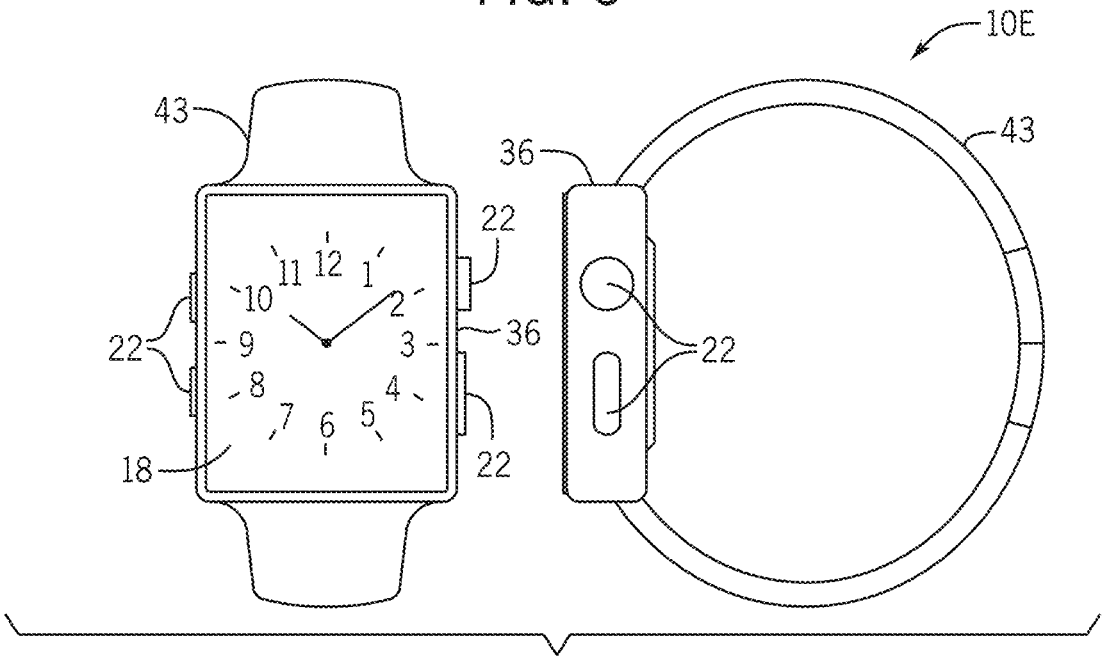
FIG. 6 is a front view and side view of a wearable electronic device representing another embodiment of the electronic device of FIG. 1.

With this in mind, a block diagram of an electronic device 10 is shown in FIG. 1 that may proactively prevent some amount of display burn-in. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or any suitable similar device.

The electronic device 10 shown in FIG. 1 may include, for example, a processor core complex 12, a local memory 14, a main memory storage 16, an electronic display 18, input structures 22, an input/output (I/O) interface 24, network interfaces 26, and a power source 28. Moreover, image processing circuitry 30 may prepare image data from the processor core complex 12 for display on the electronic display 18. Although the image processing circuitry 30 is shown as a component within the processor core complex 12, the image processing circuitry 30 may represent any suitable hardware or software that may occur between the initial creation of the image data and its preparation for display on the electronic display 18. Thus, the image processing circuitry 30 may be located wholly or partly in the processor core complex 12, wholly or partly as a separate component between the processor core complex 12, or wholly or partly as a component of the electronic display 18.

The various functional blocks shown in FIG. 1 may include hardware elements (including circuitry), software elements (including machine-executable instructions stored on a tangible, non-transitory medium, such as the local memory 14 or the main memory storage 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage 16 may be included in a single component.

The processor core complex 12 may carry out a variety of operations of the electronic device 10, such as generating image data to be displayed on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage 16. In addition to instructions for the processor core complex 12, the local memory 14 and/or the main memory storage 16 may also store data to be processed by the processor core complex 12. By way of example, the local memory 14 may include random access memory (RAM) and the main memory storage 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diode (OLED) display, an LED, or μLED display, or may be a liquid crystal display (LCD) illuminated by a backlight. In some embodiments, the electronic display 18 may include a touch screen, which may allow users to interact with a user interface of the electronic device 10. The electronic display 18 may employ display panel sensing to identify operational variations of the electronic display 18. This may allow the processor core complex 12 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra-wideband (UWB), alternating current (AC) power lines, and so forth. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hardwired connection for charging and/or content manipulation using a standard connector and protocol, such as the Lightning connector provided by Apple Inc., a universal service bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as input structures 22A or 22B (e.g., keyboard and mouse), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
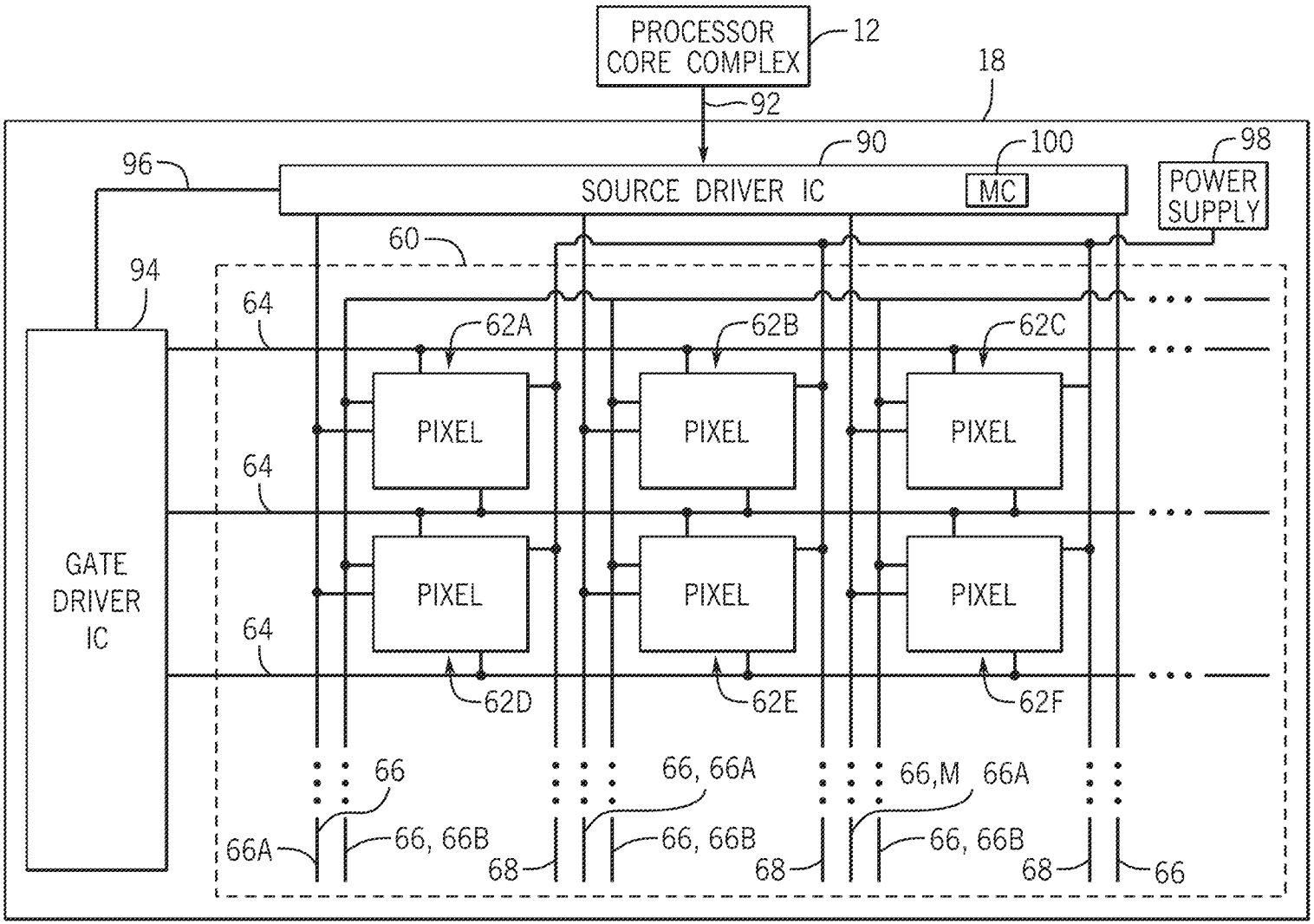
FIG. 7 is a circuit diagram illustrating a portion of an array of pixels of the display of FIG. 1, in accordance with an embodiment.

The electronic display 18 for the electronic device 10 may include a matrix of pixels that contain light-emitting circuitry. Accordingly, FIG. 7 illustrates a circuit diagram including a portion of a matrix of pixels in an active area of the electronic display 18. As illustrated, the electronic display 18 may include a display panel 60. Moreover, the display panel 60 may include multiple unit pixels 62 (here, six unit pixels 62A, 62B, 62C, 62D, 62E, and 62F are shown) arranged as an array or matrix defining multiple rows and columns of the unit pixels 62 that collectively form a viewable region of the electronic display 18, in which an image may be displayed. In such an array, each unit pixel 62 may be defined by the intersection of rows and columns, represented here by the illustrated gate lines 64 (also referred to as "scanning lines") and data lines 66 (also referred to as "source lines"), respectively. Additionally, power supply lines 68 may provide power to each of the unit pixels 62. The unit pixels 62 may include, for example, a thin film transistor (TFT) coupled to a self-emissive pixel, such as an OLED, whereby the TFT may be a driving TFT that facilitates control of the luminance of a display pixel 62 by controlling a magnitude of supply current flowing into the OLED of the display pixel 62 or a TFT that controls luminance of a display pixel by controlling the operation of a liquid crystal.

Although only six unit pixels 62, referred to individually by reference numbers 62*a*-62*f*, respectively, are shown, it should be understood that in an actual implementation, each data line 66 and gate line 64 may include hundreds or even thousands of such unit pixels 62. By way of example, in a color display panel 60 having a display resolution of 1024×768, each data line 66, which may define a column of the pixel array, may include 768 unit pixels, while each gate line 64, which may define a row of the pixel array, may include 1024 groups of unit pixels with each group including a red, blue, and green pixel, thus totaling 3072 unit pixels per gate line 64. It should be readily understood, however, that each row or column of the pixel array any suitable number of unit pixels, which could include many more pixels than 1024 or 768. In the presently illustrated example, the unit pixels 62 may represent a group of pixels having a red pixel (62A), a blue pixel (62B), and a green pixel (62C). The group of unit pixels 62D, 62E, and 62F may be arranged in a similar manner. Additionally, in the industry, it is also common for the term "pixel" may refer to a group of adjacent different-colored pixels (e.g., a red pixel, blue pixel, and green pixel), with each of the individual colored pixels in the group being referred to as a "sub-pixel." In some cases, however, the term "pixel" refers generally to each sub-pixel depending on the context of the use of this term.

The electronic display 18 also includes a source driver integrated circuit (IC) 90, which may include a chip, such as a processor or application specific integrated circuit (ASIC), that controls various aspects (e.g., operation) of the electronic display 18 and/or the panel 60. For example, the source driver IC 90 may receive image data 92 from the processor core complex 12 and send corresponding image signals to the unit pixels 62 of the panel 60. The source driver IC 90 may also be coupled to a gate driver IC 94, which may provide/remove gate activation signals to activate/deactivate rows of unit pixels 62 via the gate lines 64. Additionally, the source driver IC 90 may include a timing controller (TCON) that determines and sends timing information/image signals 96 to the gate driver IC 94 to facilitate activation and deactivation of individual rows of unit pixels 62. In other embodiments, timing information may be provided to the gate driver IC 94 in some other manner (e.g., using a controller 100 that is separate from or integrated within the source driver IC 90). Further, while FIG. 7 depicts only a single source driver IC 90, it should be appreciated that other embodiments may utilize multiple source driver ICs 90 to provide timing information/image signals 96 to the unit pixels 62. For example, additional embodiments may include multiple source driver ICs 90 disposed along one or more edges of the panel 60, with each source driver IC 90 being configured to control a subset of the data lines 66 and/or gate lines 64.

Burn-In Detection and Mitigation Using Local Tone Mapping

Figure 8:
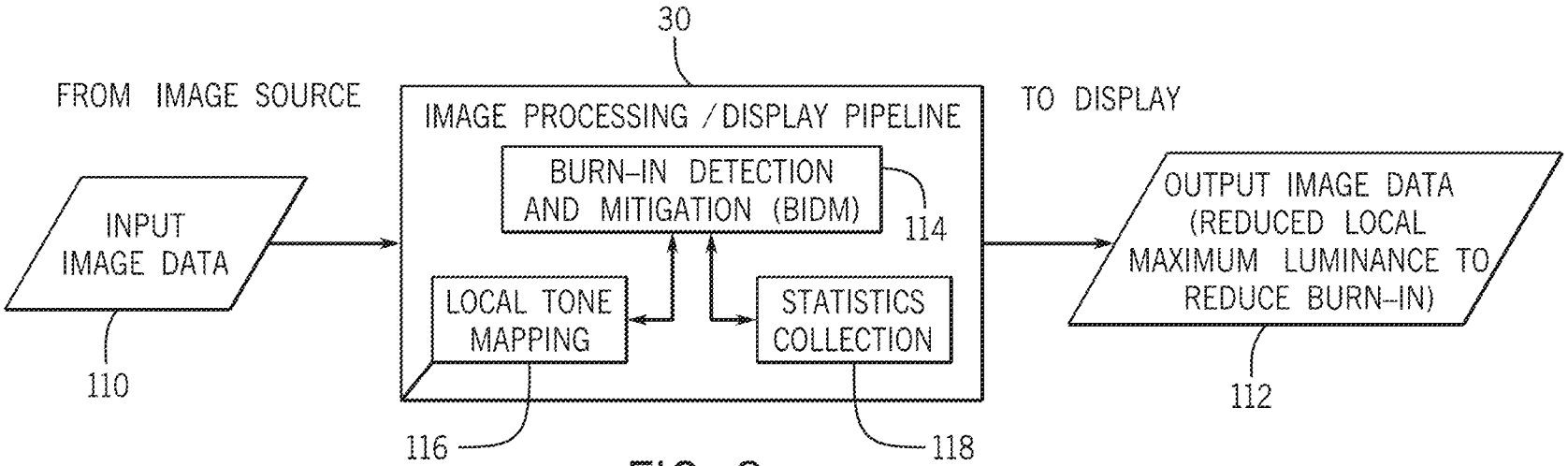
FIG. 8 is a block diagram of image processing that may be used to mitigate a risk of burn-in on the electronic display, in accordance with an embodiment.

FIGS. 8-19 relate to a manner of proactively preventing image burn-in using local tone mapping. In FIG. 8, a schematic block diagram of the image processing circuitry 30 that may be used to transform input image data 110 from an image source (e.g., a graphics processing unit (GPU) of the processor core complex 12, memory 14, and/or storage 16, or from a prior stage of the image processing circuitry 30) into output image data 112 that will go on to the electronic display 18 or to a further stage of image processing circuitry 30 before reaching the electronic display 18. The image processing circuitry 30 may represent any suitable circuitry and/or software running on a processor and/or controller that processes the input image data 110 to prepare the output image data 112 for display on the electronic display 18. As shown in FIG. 8, the image processing circuitry 30 may sometimes be referred to as a "display pipe" because it may prepare the input image data 110 for display on the electronic display 18 as the output image data 112 in sequential, pipelined stages. The image processing circuitry 30 may transform the input image data 110 into the output image data 112 that may be less likely to cause burn-in effects on the pixels 62 of the electronic display 18 when the output image data 112 is displayed on the electronic display 18. Indeed, the output image data 112 may have a reduced local maximum pixel luminance value in certain regions of the image data where the risk of burn-in on the electronic display 18 is identified to be elevated.

Before continuing, it should be noted that the image processing circuitry 30 may analyze and adjust the input image data 110 over time to produce the output image data 112. As such, the electronic display 18 may initially display output image data 112 that does not have a reduced local maximum pixel luminance value. Over time, however, to reduce display burn-in, the electronic display 18 may display output image data 112 that has been changed to have a reduced local maximum pixel luminance value. For example, at a first time, the electronic display 18 may display output image data 112 where a first region (e.g., a first cell) of the output image data has a first local maximum pixel luminance value and a second region (e.g., a second cell) of the output image data has a second local maximum pixel luminance value. By a second time, if the first region is determined not to have a high-enough risk of display burn-in but the second region is determined to have a high-enough risk of display burn in, the local maximum pixel luminance value of one of the first region may be left unchanged but the local maximum pixel luminance value of the second region may be attenuated (or vice versa).

In the example of FIG. 8, the image processing circuitry 30 includes a burn-in detection and mitigation (BIDM) block 114, a local tone mapping block 116, and a statistics collection block 118. The burn-in detection and mitigation (BIDM) block 114, the local tone mapping block 116, and the statistics collection block 118 may be implemented in the image processing circuitry 30 in any form, such as hardware, firmware, and/or software, or a combination of these. Moreover, the image processing circuitry 30 may include more or fewer or may include additional components that may be used to prepare the input image data 110 to transform the input image data 110 into the output image data 112 to improve the appearance of the output image data 112 when it is displayed on the electronic display 18. Examples of additional processing that may be found in the image processing circuitry 30 include panel response correction, white point correction, and so forth.

Figure 9:
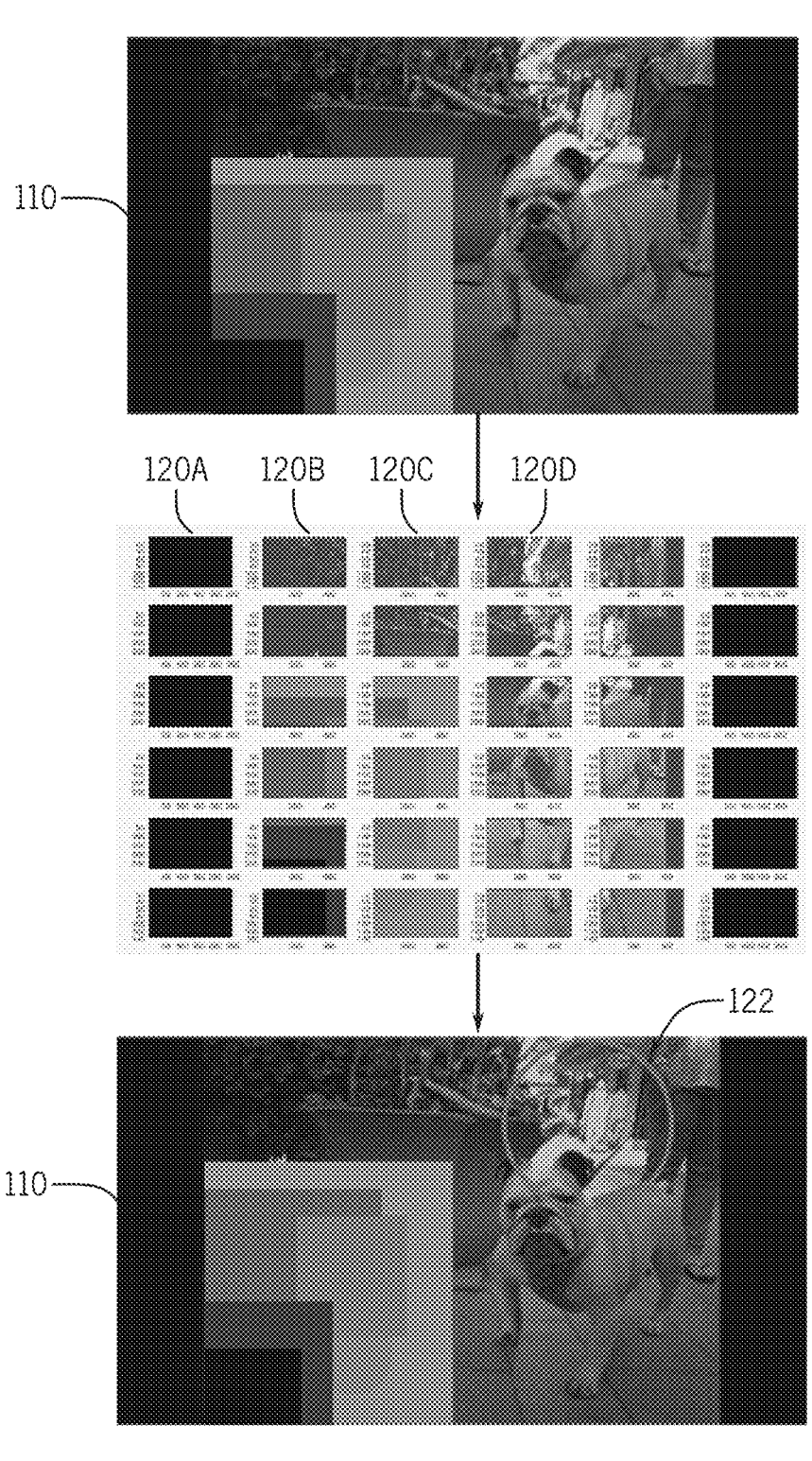
FIG. 9 is an example of image processing of an input image to produce an output image with a reduced risk of electronic display burn-in, in accordance with an embodiment.

The image processing circuitry 30 may address the risk of display pixel burn-in risk by analyzing and adjusting the input image data 110 on a regional basis, as shown in FIG. 9. In FIG. 9, the input image data 110 is represented by a frame of image data showing a photo that is to be displayed on the electronic display 18. The input image data 110 may be divided into a variety of image cells 120A, 120B, 120C, 120D . . . and so forth. The cells 120A, 120B, 120C, 120D . . . and so forth may be overlapping, as shown in FIG. 9, or may each represent or non-overlapping tiles of the input image data 110. When the cells 120A, 120B, 120C, 120D . . . and so forth are overlapping, the cells may overlap by some percentage, such as by 1%, 2%, 5%, 10%, 25%, 50%, as desired. The greater the overlap, the great the spatial-filtering effect that may occur, which may be more desirable or less desirable depending on the use case. Based on the risk of burn-in of the individual cells 120A, 120B, 120C, 120D . . . and so forth, the respective maximum pixel luminance value of any pixels in those cells 120A, 120B, 120C, 120D . . . and so forth may be adjusted down, if there is determined to be a particular risk of burn-in.

Thus, in the example of FIG. 9, a region 122 of the output image data 112 has been identified to have an elevated risk of burn-in and, accordingly, has been transformed to include a reduced local maximum pixel luminance value. Because the maximum pixel luminance value in the region 122 has been reduced in comparison to the input image data 110, there may be a lower amount of aging that occurs in the region 122 due to the brighter pixels in the region 122, which may correspondingly reduce a risk of burn-in image artifacts on the electronic display 18 over time.

Figure 10:
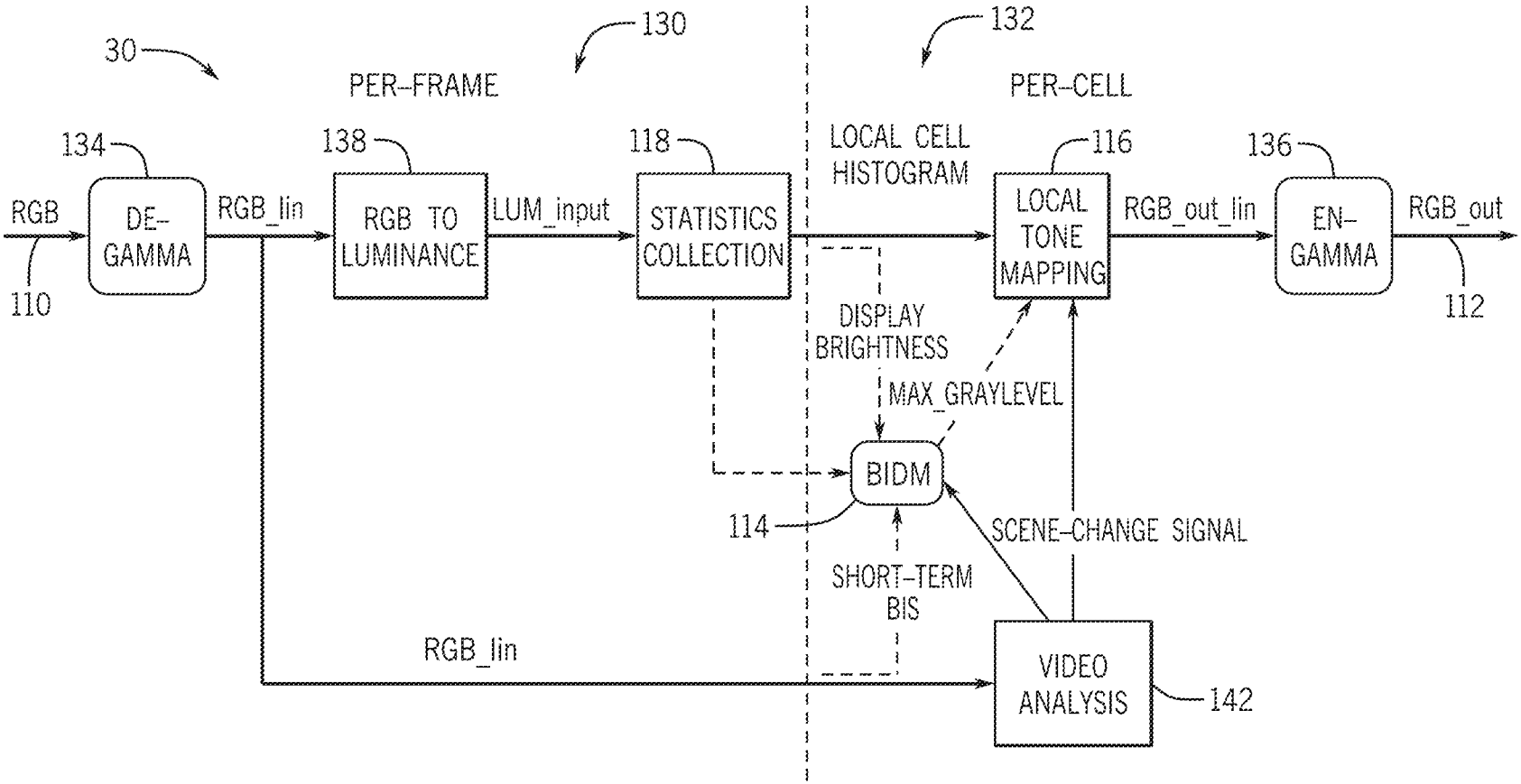
FIG. 10 is a flow diagram illustrating how the image processing may perform burn-in detection and mitigation, in accordance with an embodiment.
Figure 11:
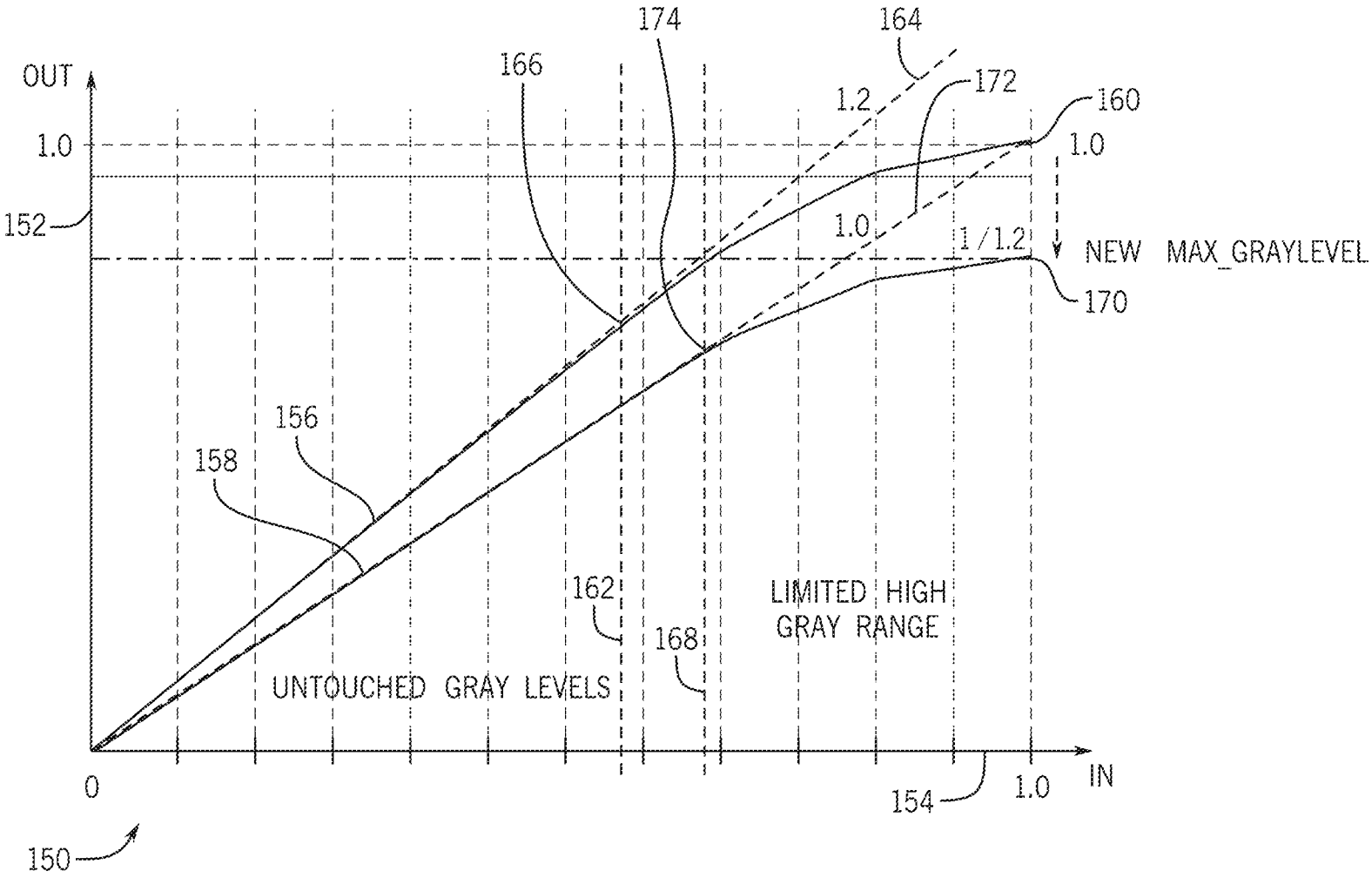
FIG. 11 is a local tone mapping curve that may be adjusted to reduce a local maximum pixel luminance value (e.g., maximum gray level) of pixels in a region of the electronic display, in accordance with an embodiment.

FIG. 10 illustrates a block diagram showing the interaction between various blocks of the image processing circuitry 30 to perform the burn-in detection and mitigation of this disclosure. A first part 130 of the image processing circuitry 30 may operate on a per-frame level, while a second part 132 of the image processing circuitry 30 may operate on a per-cell level. Indeed, as shown in FIG. 10, input image data 110 may initially have a gamma-encoded RGB (red, green, blue) image data format. The gamma-encoded RGB image data may be linearized in a de-gamma block 134 to produce linearized image data RGB_lin. The image processing described in this disclosure may take place using image data in the linear domain, and so an en-gamma block 136 may gamma-encode linear output image data RGB_out_lin to produce gamma-encoded output image data 112 (RGB_out) for display on the electronic display 18. Gamma encoding refers to a form of image data encoding that allows the human eye to more clearly see the differences between different pixel brightness values, which are also referred to as pixel gray levels or pixel luminance values.

The operative values relating to burn-in risk tend to be the luminance values. As such, an RGB-to-Luminance conversion block 138 may convert RGB pixels of the linearized image data RGB_lin into luminance values Lum_input. The RGB pixels may each represent a group of one red (R), one green (G), and one blue (B) subpixel. Each R, G, and B subpixel of an RGB pixel of the image data may be defined by different gray levels; the different gray levels of the R, G, and B subpixels is what allows the overall RGB subpixel to essentially represent any color combination. Thus, converting the RGB pixel values into luminance values may involve any suitable calculation relating the luminance values (e.g., gray levels) of the subpixels of the RGB pixel values into a luminance representation of the RGB pixel as a whole. In one example, the RGB-to-Luminance conversion block 138 may average the different gray levels of the R, G, and B subpixels of each RGB pixel. In another example, the RGB-to-Luminance conversion block 138 may select, as the luminance values of the Lum_input signal, the highest gray level of each RGB subpixel (e.g., max(R, G, B)), which may be used as an especially aggressive form of protection against burn-in that may be of particular use when a higher risk of burn-in is expected (e.g., based on content, display properties, temperature, and so forth). In another example, the RGB-to-Luminance conversion block 138 may select, as the luminance values of the Lum_input signal, the lowest gray level of each RGB subpixel (e.g., min(R, G, B)), which may be used as a milder form of protection against burn-in that may be of particular use when a lower risk of burn-in is expected (e.g., based on content, display properties, temperature, and so forth).

The luminance values Lum_input of the pixels may be received by the statistics collection block 118, which may collect the values into histograms of the luminances of the pixels in the frame of input image data 110. Additionally or alternatively, the histograms may be histogram of saturated pixels in each cell. For example, the statistics collection block 118 may produce local histograms of the luminance values for different cells of the image data 110. These histograms may take any suitable form and/or granularity. For example, the histograms may have a format of 8×4×32 (e.g., 32 bins for each, e.g., 8×4 cell) or any other suitable format. The statistics collection block 118 may provide the luminance histograms to the burn-in detection and mitigation block (BIDM) 114. The same or different local cell histograms may be provided to the local tone mapping block 116, as well. For example, the local cell histograms provided to the local tone mapping (LTM) block 116 may be finer-grained than the local cell histograms provided to the BIDM 114. This may be the case when the local cell histograms provided to the BIDM 114 are downsampled versions of the local cell histograms provided to the local tone mapping (LTM) block 116. A video analysis block 142 may identify whether a scene-change has occurred in the image data (e.g., of that cell, in another cell, or in the image frame as a whole). The video analysis block 142 may identify variations in the image data over time to identify when enough changes have taken place to signal a change in scene, which may be used to identify the extent to which certain image processing may take place, such as whether to continue to perform burn-in detection and mitigation on a particular cell, on all cells, or a subset of the cells. That is, the burn-in detection and mitigation may be performed mainly when a single scene is located in a cell for some extended period of time (e.g., a few seconds for more), since a change in scene could potentially produce image artifacts. This is particularly true if the change in scene is due to a lack of particularly bright pixels in a cell that previously held many.

The burn-in detection and mitigation (BIDM) block 114 may, on a per-cell basis, calculate a maximum pixel luminance value (max_graylevel) that could be permitted to be displayed on the display 18 from any pixel in the cell of the image data. To that end, the burn-in detection and mitigation (BIDM) block 114 may determine whether and how to compute the maximum cell luminance (max_graylevel) using the local cell histogram from the statistics collection block 118, the display brightness setting provided that determines how bright the electronic display 18 is being operated (e.g., as provided by a user via an operating system of the electronic device 10, an ambient light sensor, or the like), as well as other statistics, such as short-term or long-term burn-in-statistics (BIS), which may be calculated by the burn-in detection and mitigation (BIDM) block 114 and stored in the memory 14 or storage 16 or calculated by other circuitry (e.g., in one example, short-term burn-in statistics may be calculated as discussed below). For example, the short-term or long-term burn-in-statistics (BIS) may include the "cell risk" calculations and accumulated values discussed further below.

The local maximum pixel luminance value for each cell (max_graylevel) that is determined and output by the burn-in detection and mitigation (BIDM) block 114 may represent an attenuation value of the greatest luminance (gray level) that any pixel in that cell may have in the output image data 112. To reduce a likelihood of perceptible artifacts, the local maximum pixel luminance value (max_graylevel) may be used by the local tone mapping block 116, which may perform any suitable local tone mapping on the image data under the constraint that each cell has a local maximum pixel luminance value indicated by the attenuation value max_graylevel provided by the burn-in detection and mitigation (BIDM) block 114. The local tone mapping block 116 may also vary its operation depending on whether a scene-change has occurred, as provided by the scene-change signal from the video analysis block 142. The local tone mapping block 116 may output a linearized image output (RGB_out_lin), which is gamma-encoded by the en-gamma block 136 to produce the output image data 112 (RGB_out).

As noted above, the local tone mapping block 116 may perform local tone mapping as well as processing the image data to reduce the maximum gray level according to the value provided by the burn-in detection and mitigation (BIDM) block 114. The local tone mapping block 116 may apply any suitable local tone curve to input image data of each cell to produce locally tone-mapped image data as an output. For instance, one example is shown by a tone curve map 150 of FIG. 11. An ordinate 152 of the tone map 150 represents the output gray level normalized from 0 to 1.0, where 0 is a lowest gray level (e.g., black) and 1.0 is some maximum gray level. An abscissa 154 represents the gray levels of the input pixels, also normalized from 0 to 1.0, where 0 is the lowest gray level (e.g., black) and 1.0 is some maximum gray level. In other words, given an input pixel having a value along the abscissa 154, a corresponding output value of the ordinate 152 will be provided based on a tone curve, such as a tone curve 156 or a tone curve 158. The tone curves 156 and 158 are provided nearly by way of example to show how the local tone mapping block 116 may operate both with and without a change in maximum gray level (max_graylevel) as provided by the burn-in detection and mitigation (BIDM) block 114. In particular, the tone curve 156 represents a tone curve that might be used to enhance local contrast, and the tone curve 158 may be used to reduce a maximum gray level of the cell without distorting the most of the pixels of the cell, even if local contrast is not increased.

First, it may be understood that when the local tone mapping block 116 operates using an initial maximum gray level 160, the tone curve 156 may enhance the local contrast of some of the pixels of the cell. For example, pixels having a gray level up to a point 162 may have an amount of local contrast enhanced by a curve 164, which may increase the contrast by some amount (here, at an input:output relationship of 1:1.2). Starting at a knee point 166, however, the tone curve 156 may slowly decrease the local contrast for some limited high gray level range. That is, the local tone mapping block 116, when using the tone curve 156, may end up introducing some small number of image artifacts in pixels of gray levels where the tone curve 156 has a slope lower than 1:1, which may occur from a point 168 and higher in the input gray levels of abscissa 154 in the example of FIG. 11. To reiterate, when the local tone mapping block 116 uses a tone curve such as the tone curve 156, the gray levels of the input pixels may have locally enhanced contrast (e.g., 1:1.2) at relatively lower gray levels up to the knee point 166, may gradually reduce to an unchanged (1:1) relationship by a gray level at point 168, and may have reduced local contrast (e.g., an input:output relationship of less than 1:1) in the particularly bright pixels having gray levels higher than the gray level of point 168.

When a new, reduced maximum gray level 170 is provided to the local tone mapping block 117 by the burn-in detection and mitigation (BIDM) block 114, the local tone mapping block 116 may use a different tone curve or may adjust down a current tone curve. This is shown by way of example in the tone curve 158, which still may preserve the contrast (but may not enhance the contrast) of the input pixels having gray levels below the point 168. Indeed, in the example of FIG. 11, the tone curve 158 has an input:output relationship of 1:1 up to the gray levels of at point 168, following a curve 172. Beyond the gray levels of point 168, from a knee point 174, the tone curve 158 may reduce some of the local contrast (e.g., using an input:output relationship of less than 1:1) to reach the new maximum gray level 170 (max_graylevel). The number of pixels or the gray levels included in the limited high gray range beyond the point 168 may be selected to be small enough or high enough that this loss of contrast may be substantially imperceptible to the human eye. The number of pixels or the gray levels beyond the point 168 may be identified based, for example, on experiments with human subjects or through any suitable computer modeling.

Figure 12:
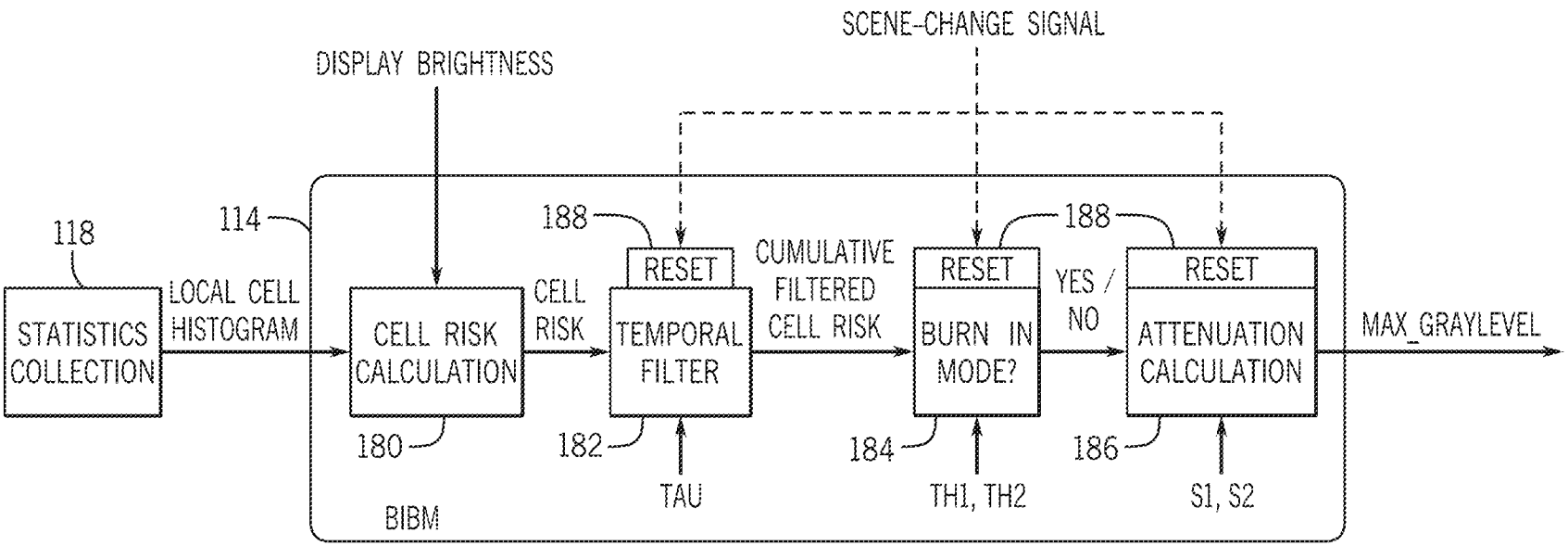
FIG. 12 is a block diagram of burn-in detection and mitigation that may take place for each cell, in accordance with an embodiment.

The local maximum pixel luminance value (max_graylevel) of each cell may be determined individually. For instance, as shown by a block diagram of FIG. 12, each cell 120 of the image data may be computed by the burn-in detection and mitigation (BIDM) block 114 in the manner shown in FIG. 12. In other words, the calculations performed by the BIDM 114 shown in FIG. 12 may be replicated for each of the cells 120 of the image data and individual local maximum pixel luminance value (individual max_graylevel signals) may be determined on a per-cell basis. As seen in FIG. 12, a local cell histogram for the currently processed cell 120 may be provided by the statistics collection block 118 to the burn-in detection and mitigation (BIDM) block 114. A burn-in risk may be calculated in a cell risk calculation block 180. The cell risk calculation block 180 may compute a maximum cell risk of burn-in and, depending on the display brightness setting, compute an instantaneous value suggesting whether pixels of the cell are likely to cause a substantially amount of burn-in.

Any suitable calculation of instantaneous cell burn-in risk may be used. One example of an instantaneous cell burn-in risk calculation may be cell_risk=((a)cell_max*(b)display brightness setting)^N. The term cell_max may represent a current maximum value of luminance in one or some number of pixels of the cell, or may represent a non-weighted or weighted average of some number or percentage of the brightest pixels in the cell. The terms a and b are any suitable weighting coefficients and N is any suitable exponent. In one case, a and b may be 1 and N may be 2, but in other cases, a, b, and N may take different values. In some cases, these values may vary depending on the circumstances of the electronic display (e.g., temperature, content, refresh rate, and so forth).

The instantaneous value of cell risk may enter a temporal filter 182 that may temporally filter and/or accumulate the instantaneous value of cell risk to produce a cumulative filtered cell risk value. The temporal filter 182 may represent any suitable filter, such as an infinite impulse response (IIR) filter or a finite impulse response (FIR), and may use any suitable value of time constant (tau). The time constant may be selected to cause the burn-in detection and mitigation (BIDM) block 114 to be long enough (e.g., for an IIR filter, 0.99, 0.95, 0.90, 0.80 in relation to time on the electronic display 18 or frames on the electronic display 18 the like) to avoid rapidly entering and exiting burn-in modes, which could introduce image artifacts. In some embodiments, the time constant tau could represent tens of seconds.

A burn-in mode block 184 may receive the cumulative filtered cell risk value and identify whether to enter or exit a burn-in mode depending on the cumulative filtered cell risk value and one or more burn-in mode thresholds (e.g., TH1 and/or TH2). These thresholds TH1 and TH2 may vary from cell to cell and/or frame to frame depending, for example, on differences in current content, content history, current brightness setting, a brightness setting history, a current ambient light level, a history of ambient light level, a display state (e.g., age, usage, etc.), and/or a history of display states, and so forth. In the example of FIG. 12, a first threshold TH1 may represent a threshold to enter the burn-in mode and a second threshold TH2 may represent a threshold to exit the burn-in mode. When the burn-in mode block 184 determines to enter the burn-in mode, an attenuation calculation 186 may compute a new local maximum pixel luminance value for that cell 120 of the image data. The attenuation calculation 186 may receive attenuation change values S1 and S2, which represent an amount or percent of change in luminance over time to use when attenuating the local maximum brightness after entering the burn-in mode (e.g., S1) or an amount of change in luminance over time to use when reversing the amount of attenuation of the local maximum brightness after exiting the burn-in mode (e.g., S2). For example, the attenuation change values S1 and/or S2 may be a change of some value per unit time on a luminance scale normalized from 0.00 to 1.00. In a few particular examples, the attenuation change value S1 or S2 may be 0.01, 0.02, 0.03, 0.04, 0.05, or the like, per frame of image data, per screen refresh (which may vary depending on the current refresh rate), or per some amount of time (e.g., 4 ms, 8 ms, 16 ms, 32 ms, 64 ms, 1 s, and or the like). In some cases, the attenuation change values S1 and S2 may be the same. In other cases, the attenuation change value S1 may be higher than the attenuation change value S2 (or vice versa). It may be beneficial, for example, to attenuate the local maximum pixel luminance value more rapidly over time when in the burn-in mode and to de-attenuate the local maximum pixel luminance value more slowly over time to avoid potential image artifacts, since the human eye may identify increases in brightness more readily than decreases in brightness. The temporal filter 182, the burn-in mode block 184, and the attenuation calculation 186 may be reset 188 when the scene-change signal indicates that a new scene is in the cell of the image data.

Figure 13:
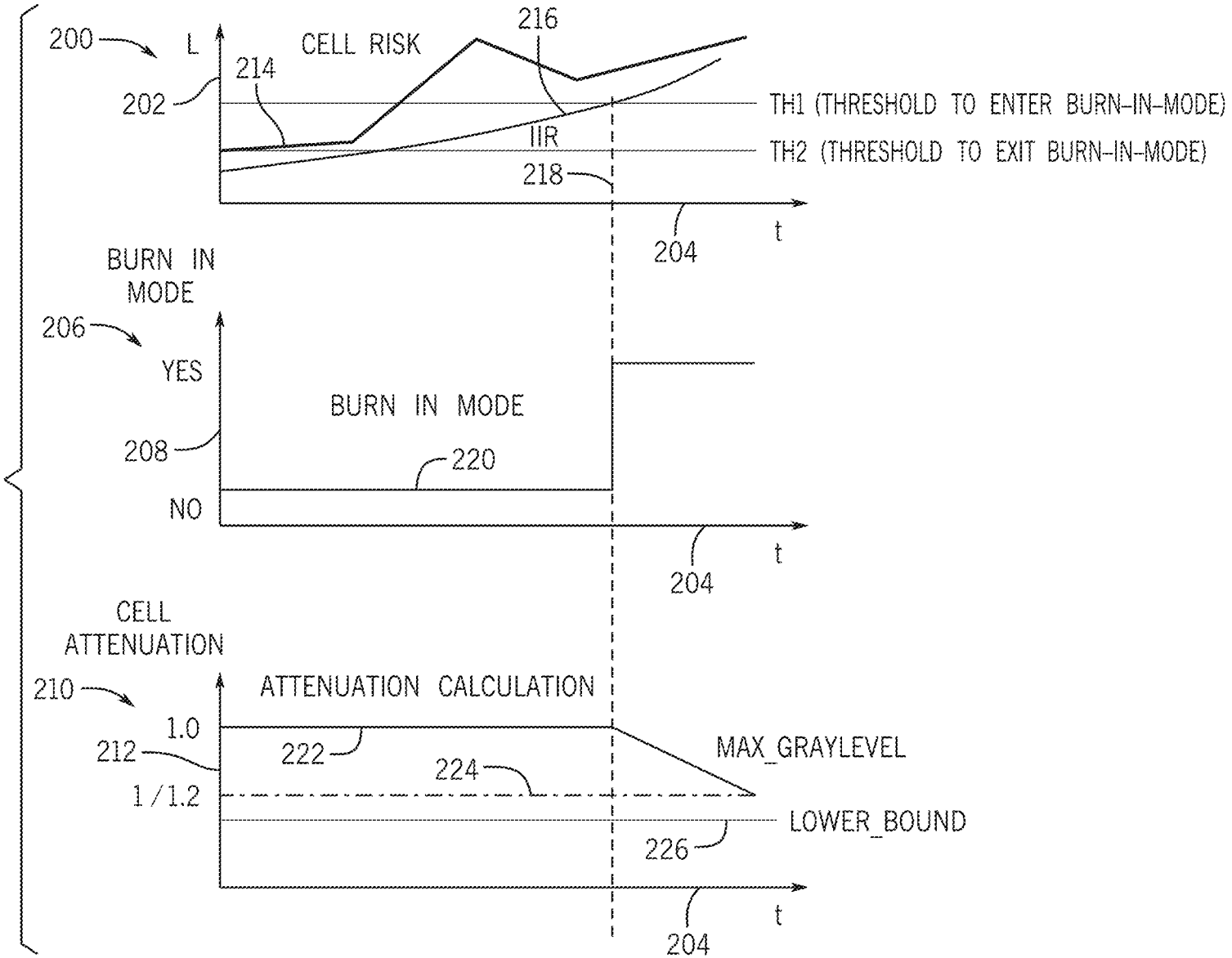
FIG. 13 is an example timing diagram illustrating the use of the burn-in detection and mitigation of FIG. 12 for one example cell, in accordance with an embodiment.

FIG. 13 represents several related timing diagrams in one example a cell of image data may be analyzed and adjusted in the burn-in detection and mitigation of this disclosure. A first timing diagram 200 of FIG. 13 illustrates cell burn-in risk (ordinate 202) in relation to time (abscissa 204); a timing diagram 206 includes illustrates whether or not burn-in mode is active (ordinate 208) in relation to time (abscissa 204); and a timing diagram 210 illustrates an amount of attenuation (ordinate 212) applied to the maximum pixel luminance value that is permitted in the cell in relation to time (abscissa 204).

As shown by the timing diagrams 200, 206, and 210, initially, an instantaneous cell risk of burn-in 214 is temporally filtered and/or accumulated into a cumulative filtered cell risk curve 216. The cumulative filtered cell risk curve 216 crosses the threshold TH1 to enter the burn-in mode at a time 218. Thus, before the time 218, the burn-in detection and mitigation (BIDM) block 114 for the cell 120 is not in burn-in mode, as seen by a curve 220. After the time 218, however, when the cumulative filtered cell risk crosses the threshold TH1, the burn-in detection and mitigation (BIDM) block 114 enters the burn-in mode.

As such, while the burn-in detection and mitigation (BIDM) block 114 is not operating in the burn-in mode before the time 218, a cell attenuation curve 222 of the timing diagram 210 remains equal to 1.0. That is, before the burn-in detection and mitigation (BIDM) block 114 enters the burn-in mode at time 218, the output of the burn-in detection and mitigation (BIDM) block 114 is not to attenuate the current local maximum pixel luminance value (e.g., as otherwise set in the local tone mapping block 116). After the time 218, however, when the burn-in detection and mitigation (BIDM) block 114 is in the burn-in mode, the attenuation calculation gradually falls to a new local maximum pixel luminance value (max_graylevel), here calculated as an attenuation value 224. Although the attenuation calculation is shown to step linearly down to the attenuation new local maximum pixel luminance value 224, any suitable linear or non-linear function may be used. A lower bound value 226 may represent a lowest possible attenuation value that may be used as a new local maximum pixel luminance value, to avoid creating a new image artifact if the local maximum pixel luminance value of the cell were otherwise selected to be so low as to be noticeable. The lower bound value 226 may vary, for example, depending on current content, content history, current brightness setting, a brightness setting history, a current ambient light level, and/or a history of ambient light level, a history of ambient light level, a display state (e.g., age, usage, etc.), and/or a history of display states, and so forth.

Figure 14:
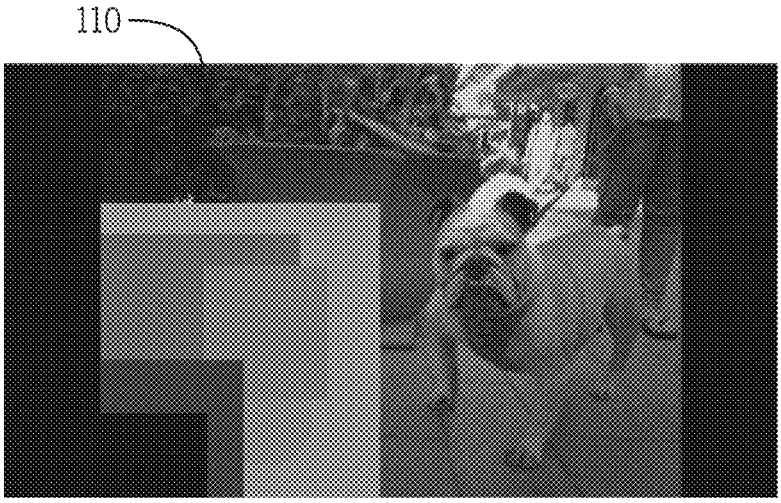
FIG. 14 is an example that may be targeted for display on the electronic display for some period of time, in accordance with an embodiment.
Figure 15:
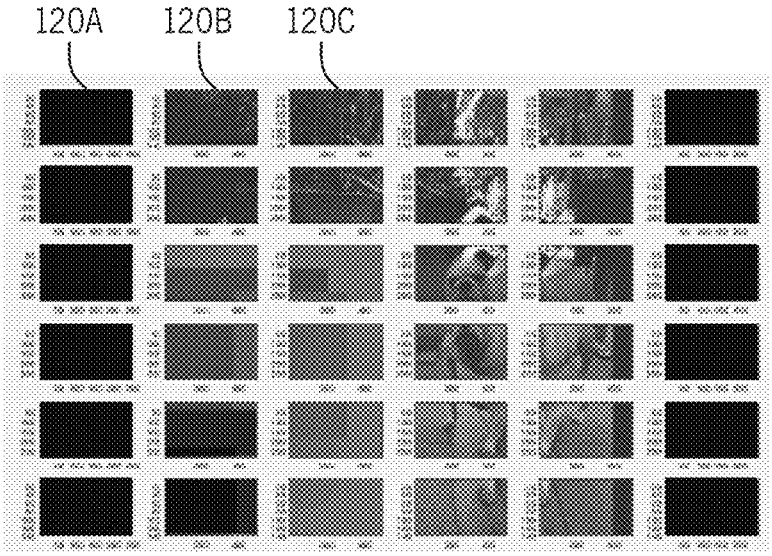
FIG. 15 is a diagram illustrating the separation of the input image data into multiple cells, in accordance with an embodiment.
Figure 16:
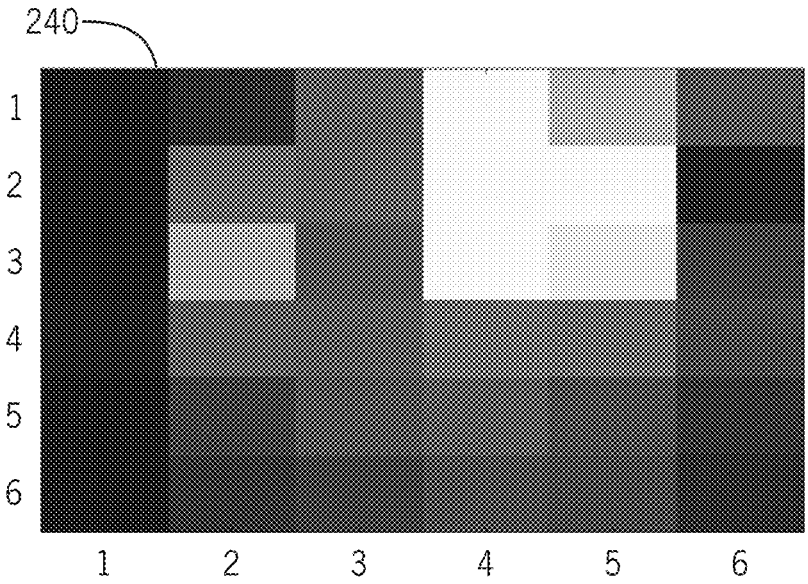
FIG. 16 is an example of a mapping of an instantaneous burn-in risk on a per-cell basis, in accordance with an embodiment.
Figure 17:
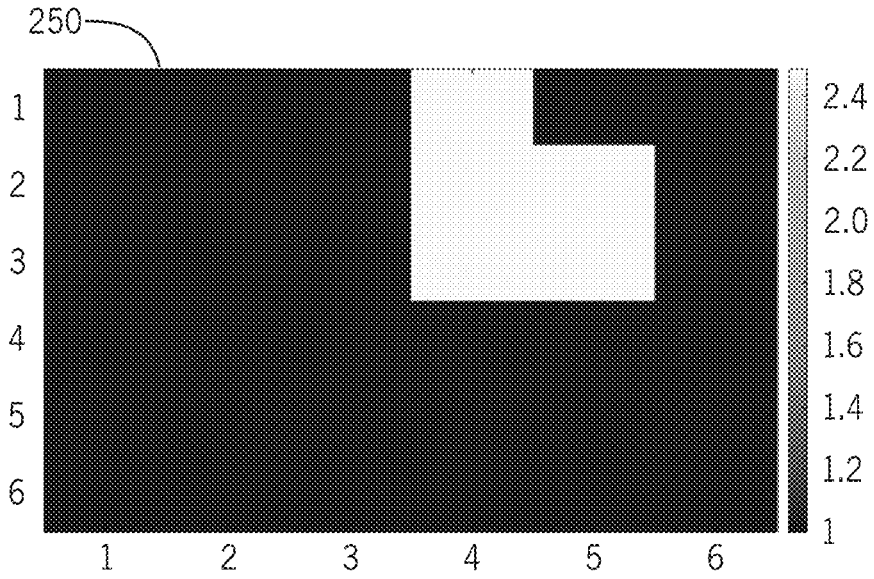
FIG. 17 is an example of a per-cell mapping of burn-in mode triggered by temporally filtered and/or accumulated cell burn-in risk, in accordance with an embodiment.

To further illustrate, FIGS. 14-19 represent an example operation of the burn-in detection and mitigation (BIDM) block 114. FIG. 14 represents an example of the input image data 110. FIG. 15 represents the cells 120A, 120B, 120C, and so forth of the input data image 110. The cells 120A, 120B, 120C may be analyzed for luminance values in each of the cells to identify an instantaneous cell burn-in risk, as shown in FIG. 16. FIG. 17 represents which cells have entered a burn-in mode, which may be determined when a cumulative and/or filtered cell risk of the instantaneous cell risk from FIG. 16 exceed some threshold TH1. This may happen, for example, a few seconds after displaying the image data on the electronic display 18.

Figure 18:
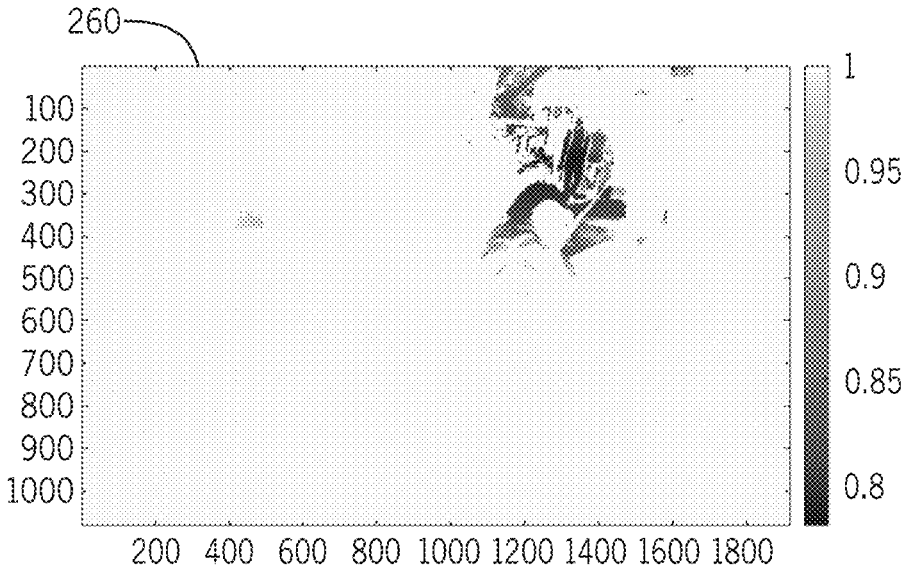
FIG. 18 is an example of changes in maximum gray level for different cells of the image frame to reduce a risk of burn-in, in accordance with an embodiment.
Figure 19:
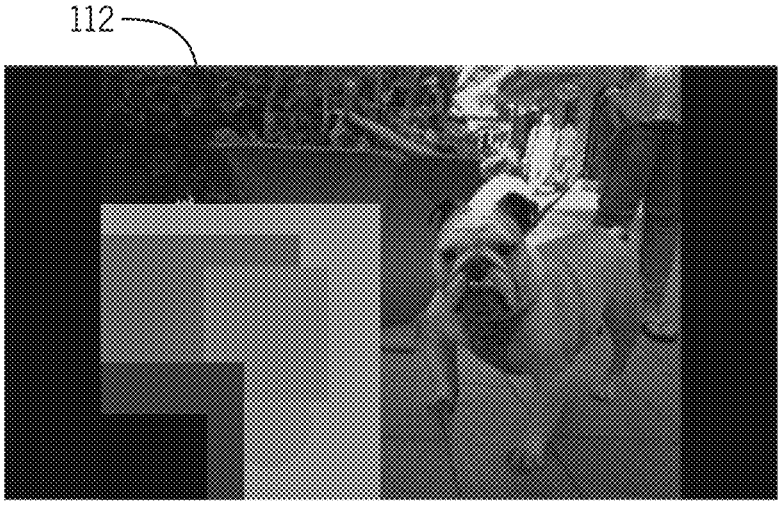
FIG. 19 is an example frame of output image data with reduced risk of burn-in due to reduced local maximum pixel luminance value, in accordance with an embodiment.

The cells that have entered the burn-in mode may begin to have an attenuated local maximum pixel luminance value within those cells that lowers over time. In FIG. 18, a frame 260 represents an amount of image attenuation applied by the local tone mapping block 116. It may be noted that the local tone mapping block 116 has mainly has reduced the gray levels of the cells in burn-in mode, but also has reduced (though to a lesser extent) other cells not in the burn-in mode as a consequence of applying local tone mapping to enhance local contrast. FIG. 19 is an example of output image data 112 that results, having lowered the local maximum pixel luminance values of certain cells at elevated risk of burn-in in a manner that is substantially imperceptible to the human eye.

Burn-In Detection and Mitigation by Adjusting Dynamic Range Headroom

Figure 20:
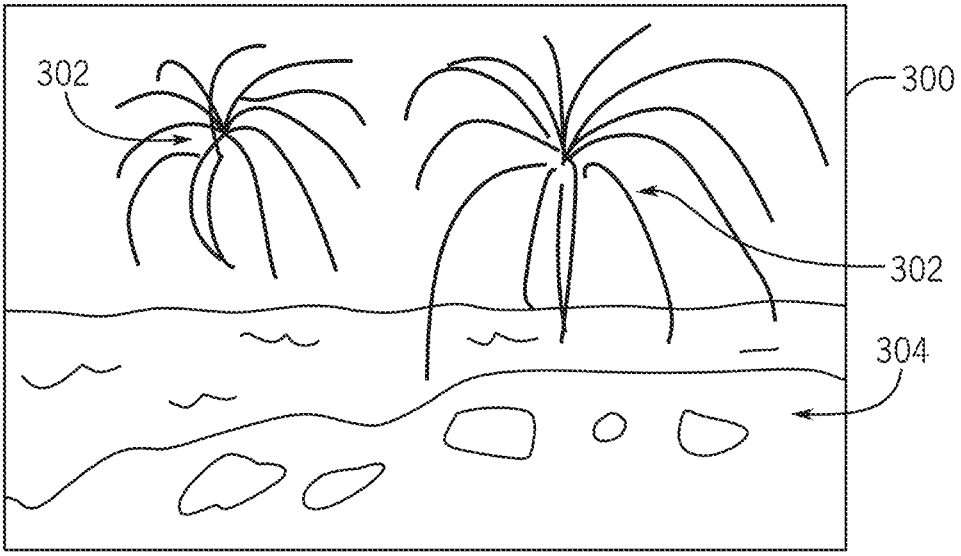
FIG. 20 is an example of a high dynamic range (HDR) image having very bright regions, in accordance with an embodiment.
Figure 21:
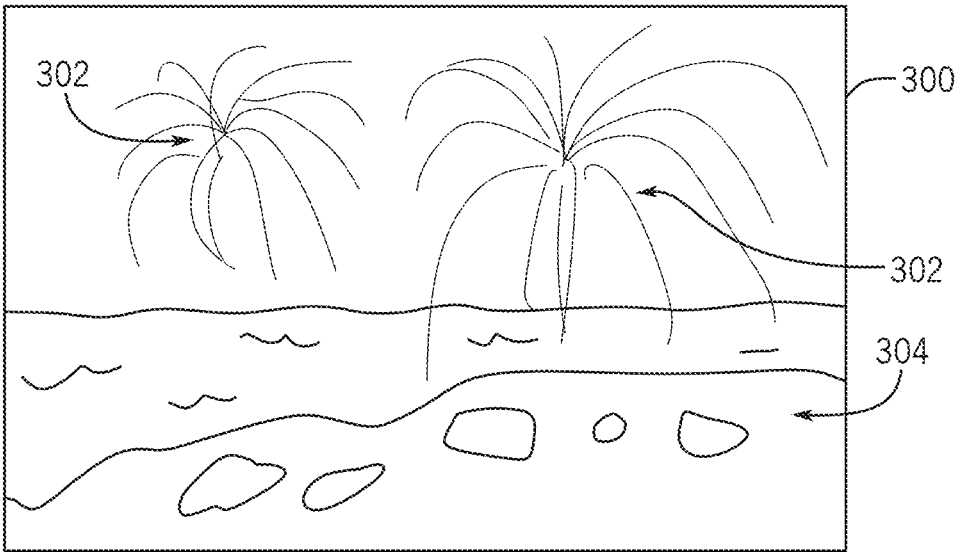
FIG. 21 is an example of an adjusted version of the HDR image of FIG. 20 after reducing a maximum dynamic range headroom for display on the electronic display, in accordance with an embodiment.
Figure 22:
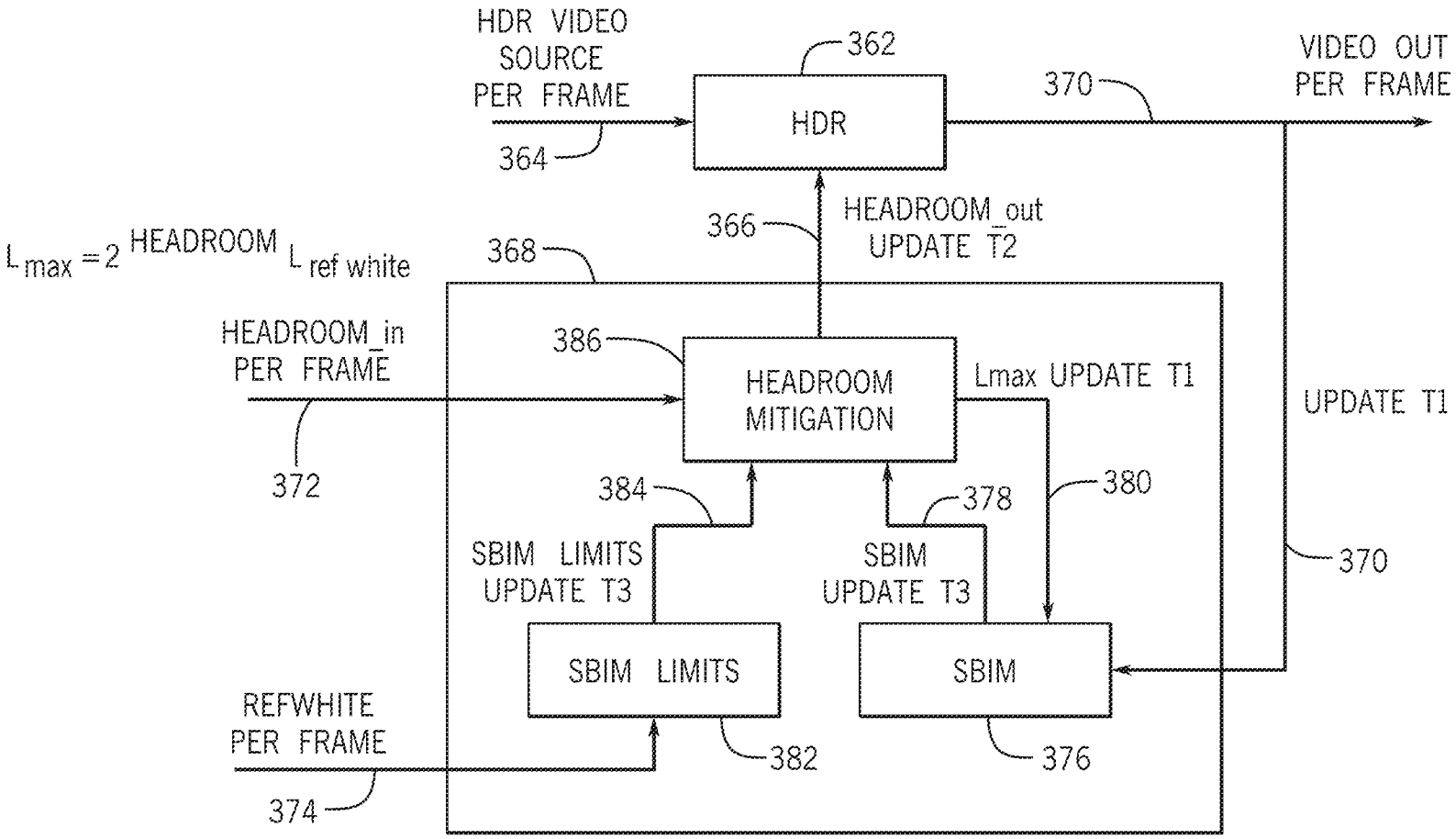
FIG. 22 is a flow diagram of a system for reducing display burn-in by reducing dynamic range headroom when a risk of burn-in exceeds a threshold value of short-term burn-in metric (SBIM) for a threshold amount of time, in accordance with an embodiment.

FIGS. 20-22 relate to another way of proactively preventing image burn-in by adjusting dynamic range headroom in response to burn-in risk. This may be particularly apt not only for high dynamic range (HDR) image data, but also for standard dynamic range (SDR) image data with especially high contrast. Dynamic range headroom represents the maximum amount of contrast in the image data that is to be displayed on the electronic display, and may be expressed in units of "stops." Image data in an HDR format may have a very high contrast that could include, in some cases, 2 or more "stops" of dynamic range headroom. In general, displaying images with more dynamic range headroom is more visually appealing because it provides for higher contrast due to a higher maximum light output for the brightest pixels (while the darkest pixels with the lowest light output may remain equally dark regardless the amount of headroom). As electronic displays increasingly gain the functionality to output higher and higher amounts of light, however, a dynamic range headroom that allows too much light to be output by the same pixels for an extended period of time could result in image burn-in in the same manner as mentioned above.

One example in which a particular risk of burn-in could arise is when a person watching a movie in a high dynamic range (HDR) format pauses the movie while some especially bright features are on the screen. FIGS. 20 and 21 provide an example in which a movie scene 300 in contains extremely bright fireworks 302 set alongside a dark coastline 304. The extremely bright fireworks 302 in this example may be particularly bright because the high dynamic range (HDR) image data that defines the movie scene 300 takes advantage of a particularly high dynamic range headroom. Although this allows for an exceptionally high contrast with excellent visual appeal, pausing the movie scene 300 for an extended time could cause the electronic display 18 to suffer from burn-in. Under these conditions, burn-in is most likely to occur on the pixels of the electronic display 18 that display the extremely bright fireworks 302. By reducing the dynamic range headroom under conditions where the risk of burn-in is elevated, the likelihood of burn-in may be mitigated without substantially impacting the visual appeal of images being displayed. For example, as shown in FIG. 21, the dynamic range headroom of the movie scene 300 may be reduced enough to lower the brightness of the extremely bright fireworks 302 without distorting the rest of the image (e.g., without scaling the entire image). Thus, in the example of the movie scene 300, lowering the dynamic range headroom may reduce a likelihood of burn-in by lowering the brightness of the pixels displaying the extremely bright fireworks 302 without changing the pixels displaying the dark coastline 304.

To prevent burn-in in situations such as these, a variety of different metrics may be used to ascertain when a likelihood of burn-in may occur based on the image data that is being output for display on the electronic display 18. For example, a short-term burn-in metric (SBIM) may be derived from brightness and temperature information of individual red, green, and blue subpixels, calculated over a frame or accumulation of frames of image data.

Burn-in risk calculations such as the SBIM calculations mentioned above may be used to ascertain when there is a particular risk of burn-in on the electronic display 18 so that action can be taken to mitigate burn-in. Indeed, different threshold levels of burn-in risk may be permitted for different maximum brightness levels that are to be shown on the electronic display 18 (e.g., in relation to some maximum brightness in a particular dynamic range, such standard dynamic range (SDR), which may represent the number of nits to be output on the electronic display 18 for standard dynamic range images, and which may be referred to as Reference White). Beyond these threshold levels of burn-in risk, a reduction in dynamic range headroom may be triggered to mitigate burn-in.

Different SBIM limits may be used to trigger burn-in mitigation via dynamic range headroom reduction for different color components and/or different temperatures. Indeed, since temperature may impact the likelihood of burn-in on the electronic display 18, the SBIM limits may be different for different temperatures. For instance, in one example, a higher temperature may call for higher limits. In other examples, a higher temperature may call for lower limits. For instance, SBIM limits may be normalized to a particular temperature of the electronic device 10 (e.g., T=35° C.). When the electronic device 10 has a different temperature, a gain may be applied to the different color components. In one example (e.g., T=40° C.), the SBIM limits may be gained by color component (e.g., red may be gained more than green, green may be gained more than blue). In this way, different SBIM limits may be chosen for different temperatures. In another example, a single set of SBIM limits may be selected for a likely temperature or likely maximum temperature that the electronic device 10 is expected to take when displaying HDR content.

One example use case is playing a movie at an intermediate reference white value. Various discrete periodic calculations of SBIM may be obtained for three different color components (red, green, and blue) over time while a movie is playing. Keeping in mind that different color components may have different SBIM limits (thresholds) to take action at intermediate reference white values, when the SBIM values for a particular color component exceed a threshold for some extended period of time, the dynamic range headroom may be reduced to mitigate the likelihood of burn-in on the electronic display 18.

For example, a burn-in mitigation system 360 of FIG. 22 may adjust the dynamic range headroom in response to the content of image data that is displayed on the electronic display 18. The burn-in mitigation system 360 may adjust the dynamic range headroom to reduce a likelihood of burn-in on the electronic display 18. The various blocks of the burn-in mitigation system 360 may be implemented in circuitry, software (e.g., instructions running on one or more processors), or some combination of these. For example, some of the blocks may be implemented in an application-specific integrated circuit (ASIC) while others may be implemented in an operating system (OS), application program, or firmware of the electronic device 10. In the example of FIG. 22, a high dynamic range (HDR) image processing block 362 receives HDR image data 364 from an HDR video source (e.g., a GPU of the processor core complex 12) on a per-frame basis. Although the example of FIG. 22 uses high dynamic range (HDR) image data 364, which has a much higher contrast than standard dynamic range (SDR) image data, the system 360 may operate on SDR image data in addition to or alternatively to the HDR image data 364, but the amount of burn-in reduction due to dynamic range headroom changes would likely be less pronounced.

The HDR image processing block 362 receives an indication of a maximum amount of dynamic range headroom that is allowed for the HDR image data 364, shown as Headroom_out 366, from a dynamic range headroom mitigation block 368. The HDR image processing block 362 may adjust the HDR image data by lowering the brightest pixels accordingly using the maximum allowed dynamic range headroom (Headroom_out 366). Having adjusted the HDR image data 364, the HDR image processing block 362 provides output HDR image data 370 to the electronic display 18 or to a further image processing block.

The dynamic range headroom mitigation block 368 determines the maximum amount of dynamic range headroom that is allowed for the HDR image data 364, shown as Headroom_out 366, using several inputs. These include an input amount of dynamic range headroom (Headroom_in 372) of the input HDR image data 364, the reference white brightness level (RefWhite) to be displayed on the electronic display 18, and the output HDR image data 370. An SBIM calculation block 376 may calculate the short-term burn-in metric (SBIM) values 378 using the output HDR image data 370 and a maximum luminance Lmax 380. An SBIM limits block 382 may determine the particular SBIM thresholds for each of the color components, here output as SBIM limits 384. As discussed above, the SBIM limits may be constant for all temperature values of the electronic device 10, or may vary depending on the temperature of the electronic device 10.

A dynamic range headroom calculation block 386 may use the input amount of dynamic range headroom (Headroom_in 372), the short-term burn-in metric (SBIM) values 378, and the SBIM limits 384 to identify when to adjust the dynamic range headroom and by how much. The dynamic range headroom calculation block 386 may follow any suitable control methods. In one embodiment, the various values shown in FIG. 22 may be received or computed as rapidly as possible (e.g., on a per-frame basis). Since this may be inefficient, however, certain values may be received or computed less often. For example, the input amount of dynamic range headroom (Headroom_in 372) and the reference white brightness level (RefWhite) to be displayed on the electronic display 18 may be received on a per-frame basis; the output HDR image data 370 (or an accumulation or filtered sample of the HDR image data 370) and the Lmax 380 may be received or calculated less frequently, at a period of T1 (e.g., about once per half-second, once per second, or once per every few seconds); the maximum amount of dynamic range headroom (Headroom_out 366) may be received or calculated still less frequently, at a period of T2 (e.g., once every few seconds, such as once every 5 seconds, once every 10 seconds, once every 30 seconds, or the like); and the SBIM limits 384 and the SBIM values 378 may be received or calculated still less frequently, at a period of T3 (e.g., once every 10 seconds, once every 30 seconds, once every minute, once every 2 minutes, once every 3 minutes, once every 5 minutes, or the like).

The dynamic range headroom calculation block 386 may operate to mitigate burn-in risk when the SBIM values 378 indicate a particular likelihood of burn-in risk. Any suitable framework may be used. For example, the system 360 may gradually start decreasing the dynamic range headroom to mitigate the risk of burn-in on the electronic display 18 in response to some number N (e.g., 1, 2, 3, 4, 5, 10, 15, 20, 30, 50, 100, or the like) consecutive T3 periods of a violation. A violation may occur when the SBIM values 378 for a particular color component exceed a corresponding SBIM limit 384. The system 360 may decrease the dynamic range headroom at any suitable rate. For example, the dynamic range headroom may be decreased as a reduction in one stop of dynamic range headroom over some number N (e.g., 1, 2, 3, 4, 5, 10, 15, 20, 30, 50, 100, or the like) consecutive T3 periods. This may reduce the likelihood of burn-in while changing slowly enough so as not to be noticeable by a viewer of the electronic display 18. This may continue until there is no longer a violation or until there is no SBIM violation for some period of time.

Once there has been a consistent amount of time without SBIM violations, the system 360 may gradually start increasing the dynamic range headroom to mitigate the risk of burn-in on the electronic display 18. This may occur, for example, after some number N (e.g., 1, 2, 3, 4, 5, 10, 15, 20, 30, 50, 100, or the like) consecutive T3 periods of no violations. The system 360 may gradually increase the dynamic range headroom at any suitable rate. For example, the dynamic range headroom may be increased at a rate of one stop of dynamic range headroom over some number N (e.g., 1, 2, 3, 4, 5, 10, 15, 20, 30, 50, 100, or the like) consecutive T3 periods. This may continue until there is an SBIM violation or until there are some number of SBIM violations over some period of time, or until the entire dynamic range headroom is restored.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

image processing circuitry configured to:

receive image data;

analyze the image data for risk of image burn-in, wherein analyzing the image data for the risk of image burn-in comprises determining a burn-in risk value, wherein the image processing circuitry is configured to:

enable a burn-in mode in response to the burn-in risk value being greater than a first threshold risk value; and in response to the burn-in mode being enabled and the burn-in risk value being less than a second threshold risk value that is less than the first threshold risk value, disable the burn-in mode; and in response to the burn-in mode being enabled based at least in part on the analysis of the image data, reduce the risk of image burn-in based at least in part by reducing a local maximum pixel luminance value in at least one of a plurality of regions of the image data or by reducing a dynamic range headroom of the image data; and an electronic display configured to display the image data with the reduced risk of image burn-in.

2. The electronic device of claim 1, wherein the image processing circuitry is configured to analyze the plurality of regions of the image data for the risk of image burn-in and reduce respective local maximum pixel luminance values of respective regions of the plurality of regions that are determined to have the risk of image burn-in.

3. The electronic device of claim 2, wherein the plurality of regions are at least partially overlapping.

4. The electronic device of claim 2, wherein the plurality of regions are non-overlapping.

5. The electronic device of claim 1, wherein the image processing circuitry is configured to reduce the local maximum pixel luminance value in the at least one of the plurality of regions of the image data over time to reduce the risk of image burn-in using a combination of hardware and software.

6. The electronic device of claim 1, wherein the image processing circuitry is configured to reduce the local maximum pixel luminance value without reducing a local contrast of most gray levels of pixels of the image data in the at least one of the plurality of regions of the image data.

7. The electronic device of claim 1, wherein the electronic display comprises an active area with self-emissive pixels that display the image data.

8. The electronic device of claim 1, wherein the risk of image burn-in is computed on a per-color-component basis.

9. The electronic device of claim 1, wherein analyzing the image data for the risk of image burn-in comprises determining whether the risk of image burn-in exceeds a threshold risk of image burn-in for a threshold amount of time, and wherein the threshold amount of time is greater than one minute.

10. The electronic device of claim 1, wherein analyzing the image data for the risk of image burn-in comprises determining whether the risk of image burn-in exceeds a threshold risk of image burn-in for a threshold amount of time, and wherein the dynamic range headroom of the image data is reduced over time until the risk of image burn-in does not exceed the threshold risk of image burn-in.

11. The electronic device of claim 10, wherein the dynamic range headroom of the image data is reduced at a rate of one stop per at least one minute.

12. A method comprising:

at a first time, displaying a first image frame on an electronic display to have a first local maximum pixel luminance value in a first region of the electronic display and a second local maximum pixel luminance value in a second region of the electronic display;

determining a first burn-in risk value based at least in part on analysis of first image data associated with the first region, wherein the first burn-in risk value is temporally filtered;

determining a second burn-in risk value based at least in part on analysis of second image data associated with the second region, wherein the second burn-in risk value is temporally filtered; and at a second time, displaying a second image frame on the electronic display that:

in response to the first burn-in risk value being less than a threshold risk value, has the first local maximum pixel luminance value in the first region of the electronic display; and in response to the second burn-in risk value being greater than the threshold risk value, has an attenuated second local maximum pixel luminance value in the second region of the electronic display, wherein the second local maximum pixel luminance value is attenuated based at least in part by locally tone mapping the second region.

13. The method of claim 12, wherein displaying the second image frame on the electronic display to have the attenuated second local maximum pixel luminance value comprises reducing the second local maximum pixel luminance value over time, and wherein locally tone mapping the second region comprises mapping at least a portion of gray levels in the second region to lower-level gray levels using a tone curve that maps input luminance values above a threshold luminance to reduced luminance values but does not map input luminance values below the threshold luminance to reduced luminance values.

14. The method of claim 12, comprising, at the second time, reducing a dynamic range headroom in the first region of the electronic display and in the second region of the electronic display, thereby reducing a risk of image burn-in in at least the second region of the electronic display.

15. The method of claim 12, wherein the first image frame and the second image frame are different.

16. A system comprising:

an electronic display configured to display image data; and a display pipeline communicatively coupled to the electronic display, wherein the display pipeline is configured to:

collect image statistics of the image data;

identify whether a first cell of a plurality of cells of the image data has an elevated likelihood of burn-in based at least in part on the image statistics; and in response to identifying that the first cell has the elevated likelihood of burn-in, reduce a local maximum pixel luminance value of the first cell to reduce a likelihood of burn-in when the image data is displayed on the electronic display, wherein the display pipeline is configured to identify that the first cell of the image data has the elevated likelihood of burn-in and enter a burn-in mode when a cumulative value of a risk of cell burn-in over time exceeds a first threshold, wherein the display pipeline is configured to identify that the first cell of the image data no longer has the elevated likelihood of burn-in and exit the burn-in mode when the cumulative value of the risk of cell burn-in over time falls beneath a second threshold, wherein the second threshold is lower than the first threshold, wherein the display pipeline is configured to reduce the local maximum pixel luminance value of the first cell upon entering the burn-in mode based at least in part by reducing the local maximum pixel luminance value of the first cell at a first rate over time and, upon exiting the burn-in mode, increasing the local maximum pixel luminance value of the first cell at a second rate over time that is slower than the first rate.

17. The system of claim 16, wherein the display pipeline is configured to collect the image statistics of the image data by computing respective local histograms of luminance values of pixels in respective cells of the image data.

18. The system of claim 16, wherein the display pipeline is configured to identify whether the first cell of the image data has the elevated likelihood of burn-in based at least in part on a highest pixel luminance in the first cell.

19. The system of claim 16, wherein the display pipeline is configured to identify whether the first cell of the image data has the elevated likelihood of burn-in based at least in part by temporally filtering, accumulating, or both, a cell risk value computed based at least in part on the image statistics.

20. The system of claim 19, wherein the display pipeline is configured to identify whether the first cell of the image data has the elevated likelihood of burn-in based at least in part by temporally filtering or accumulating, or both, the cell risk value using an infinite impulse response filter.

21. The system of claim 16, wherein the display pipeline is configured to reduce the local maximum pixel luminance value of the first cell based at least in part by locally tone mapping the first cell using a tone curve that maps input luminance values above a threshold luminance to reduced luminance values but does not map input luminance values below the threshold luminance to reduced luminance values.

22. The system of claim 16, wherein the display pipeline is configured to compute a second value of a risk of burn-in of the image data, determine whether the second value of the risk of burn-in exceeds a threshold risk of burn-in for a threshold amount of time, and in response to determining that the second value of the risk of burn-in exceeds the threshold risk of burn-in for the threshold amount of time, reduce a dynamic range headroom of the image data to reduce the likelihood of burn-in when the image data is displayed on the electronic display.

23. The system of claim 16, wherein the display pipeline is configured to:

at a first time, based on the image data, output a same image frame to the electronic display to have a second local maximum pixel luminance value in a first region of the electronic display and the local maximum pixel luminance value in a second region of the electronic display, wherein the second region comprises the first cell of the plurality of cells; and at a second time, output the same image frame to the electronic display to have the second local maximum pixel luminance value in the first region of the electronic display and to have the reduced local maximum pixel luminance value in the second region of the electronic display, thereby reducing a risk of image burn-in in the second region of the electronic display.

* * * * *